US010466635B2

(12) United States Patent
Sasaki

(10) Patent No.: US 10,466,635 B2
(45) Date of Patent: Nov. 5, 2019

(54) IMAGE FORMING APPARATUS, METHOD OF CONTROLLING THE SAME, AND STORAGE MEDIUM THAT SELECT, FROM AMONG A PLURALITY OF PAPER FEED SOURCES, ONE THAT SATISFIES A SELECTED CONDITION

(71) Applicant: CANON KABUSHIKI KAISHA, Tokyo (JP)

(72) Inventor: Hidemi Sasaki, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/133,056

(22) Filed: Sep. 17, 2018

(65) Prior Publication Data

US 2019/0086849 A1 Mar. 21, 2019

Related U.S. Application Data

(63) Continuation of application No. 15/540,064, filed as application No. PCT/JP2016/000255 on Jan. 19, 2016, now Pat. No. 10,120,314.

(30) Foreign Application Priority Data

Jan. 22, 2015 (JP) ..... 2015-010678

(51) Int. Cl.
*G03G 15/00* (2006.01)
*B65H 7/02* (2006.01)
(Continued)

(52) U.S. Cl.
CPC ..... *G03G 15/5029* (2013.01); *B41J 29/38* (2013.01); *B65H 7/02* (2013.01);
(Continued)

(58) Field of Classification Search
CPC ..... G03G 15/5029; B65H 7/02
See application file for complete search history.

(56) References Cited

U.S. PATENT DOCUMENTS 4,763,889 A 8/1988 Dei et al.
5,806,843 A * 9/1998 Hansen ..... B65H 7/125 271/263

(Continued)

FOREIGN PATENT DOCUMENTS

JP 2001-333249 A 11/2001
JP 2010-282204 A 12/2010

(Continued)

OTHER PUBLICATIONS

Intl. Patent Appln. Publn. No. WO2016117333, including International Search Report dated Apr. 19, 2016, in Intl. Patent Appln. No. PCT/JP2016/000255.

*Primary Examiner* — G. M. A Hyder
(74) *Attorney, Agent, or Firm* — Venable LLP

(57) ABSTRACT

An image forming apparatus forms an image designated by a job on a sheet fed from one of a plurality of paper feed sources. A detection unit detects paper types of sheets respectively fed from the plurality of paper feed sources, and is provided on a conveyance path. A memory device stores a set of instructions, and at least one processor executes the instructions to function as a first holding unit to hold paper sizes and paper types set by a user in one-to-one correspondence with the plurality of paper feed sources, a second holding unit to hold the paper types detected by the detection unit in one-to-one correspondence with the plurality of paper feed sources, and a third holding unit to hold a paper size designated by the job and a paper type designated by the job or a condition related to setting of a paper type.

6 Claims, 22 Drawing Sheets

(51) Int. Cl.

| | |
|---|---|
| ***B41J 29/38*** | (2006.01) |
| ***G03G 21/00*** | (2006.01) |
| *B65H 5/06* | (2006.01) |

(52) U.S. Cl.

CPC ..... *G03G 15/6508* (2013.01); *G03G 21/00* (2013.01); *B65H 5/06* (2013.01); *B65H 2701/1131* (2013.01); *G03G 2215/00603* (2013.01); *G03G 2215/00734* (2013.01); *G03G 2215/00751* (2013.01); *G03G 2215/0132* (2013.01)

(56) References Cited

U.S. PATENT DOCUMENTS

| | | | |
|---|---|---|---|
| 7,433,645 | B2 | 10/2008 | Aiyama |
| 8,967,754 | B2 | 3/2015 | Yano |
| 9,030,684 | B2 | 5/2015 | Saito |
| 2002/0024575 | A1 | 2/2002 | Sato |
| 2002/0027667 | A1 | 3/2002 | Takami et al. |
| 2005/0088710 | A1 | 4/2005 | Nakayama |
| 2006/0045547 | A1* | 3/2006 | Aiyama ..... G03G 15/6508 399/16 |
| 2006/0164456 | A1 | 7/2006 | Yamagishi et al. |
| 2006/0237902 | A1 | 10/2006 | Yoshizawa et al. |
| 2009/0057995 | A1 | 3/2009 | Murakami et al. |
| 2009/0251715 | A1 | 10/2009 | Kita |
| 2010/0195126 | A1 | 8/2010 | Shiozawa |
| 2010/0310261 | A1 | 12/2010 | Matsushima |
| 2011/0229179 | A1 | 9/2011 | Yoshida et al. |
| 2014/0270822 | A1 | 9/2014 | Yamashina et al. |
| 2015/0205241 | A1 | 7/2015 | Yamashina et al. |
| 2016/0378414 | A1 | 12/2016 | Oya |

FOREIGN PATENT DOCUMENTS

| | | | |
|---|---|---|---|
| JP | 2013-236178 | A | 11/2013 |
| JP | 2013-256097 | A | 12/2013 |

* cited by examiner

IMAGE FORMING APPARATUS, METHOD OF CONTROLLING THE SAME, AND STORAGE MEDIUM THAT SELECT, FROM AMONG A PLURALITY OF PAPER FEED SOURCES, ONE THAT SATISFIES A SELECTED CONDITION

This application is a continuation of U.S. patent application Ser. No. 15/540,064, filed Jun. 27, 2017, now U.S. Pat. No. 10,120,314, issued Nov. 6, 2018, which is a national stage entry of International Patent Application No. PCT/JP2016/000255, filed on Jan. 19, 2016, which claims the benefit of Japanese Patent Application No. 2015-10678, filed Jan. 22, 2015, which are hereby incorporated by reference herein in their entireties.

TECHNICAL FIELD

The present invention relates to an image forming apparatus, a method of controlling the same, and a storage medium.

BACKGROUND ART

Image forming apparatuses that include a plurality of paper feed sources and form an image on a sheet fed from a selected paper feed source are widely known. A user who performs printing using such image forming apparatuses issues a print instruction by designating a paper feed source from which a loaded sheet is to be fed for printing via a printer driver. Japanese Patent Laid-Open No. 2013-256097 suggests a setting that causes an image forming apparatus to automatically select a paper feed source loaded with sheets that satisfy print conditions designated by a user via a printer driver.

Sheets to be used in image forming apparatuses for printing come in a wide variety of types, from thick paper to thin paper. Therefore, image forming conditions, such as a fixing temperature and a conveyance speed, are changed in accordance with a paper type in the image forming apparatuses to suppress, for example, detachment of fixed toner and curling of sheets.

Conventionally, the types of sheets loaded in paper feed sources of image forming apparatuses are manually set by a user. In some image forming apparatuses of today, paper feed sources are provided with sensing devices called media sensors, and the types of sheets loaded in the paper feed sources are automatically detected by observing the optical characteristics of the surfaces of such sheets. Japanese Patent Laid-Open No. 2013-236178 and Japanese Patent Laid-Open No. 2010-282204 disclose a technique to cause an image forming apparatus to discharge a blank sheet without performing printing when the paper type detected by a media sensor does not match the paper type designated by a user via a printer driver.

Providing each paper feed source with a media sensor in the above-described manner leads to a cost increase. In view of this, a media sensor used in common can be provided on a conveyance path for sheets. With this structure, the type of a sheet conveyed from each paper feed source can be detected when the sheet is at the position of the sensor. In this case, if it is determined that the type of a sheet detected by the media sensor is inappropriate because it does not match the paper type set by a user for printing, the presence of the sheet on the conveyance path prohibits feeding of a sheet from another paper feed source.

With conventional technology, when the detected paper type does not match the paper type set by a user, a blank sheet is discharged without performing printing. The presence of a blank sheet in printed products indicates, however, the presence of an unintended sheet, and this could be undesirable for the user. Furthermore, when a paper feed source to be used in printing is automatically selected, the type of sheets loaded in each paper feed source is unknown at the start of a job. Therefore, it may be necessary to convey a sheet loaded in each paper feed source to the position of a media sensor to detect its paper type. If the detection result does not match the paper type included in the print settings configured by the user, the sheet is discharged as-is, that is to say, as a blank sheet. Such a presence of a blank sheet in printed products means the presence of an unintended sheet, this could be undesirable for the user.

SUMMARY OF INVENTION

An object of the present invention is to eliminate the above-mentioned problems with conventional technology.

A feature of the present invention is to provide a technique to enable appropriate determination of a paper feed source to be used in printing to suppress a discharge of a blank sheet, even in the case of a structure that detects a paper type by feeding a sheet from a paper feed source to a conveyance path.

In one aspect, the present invention provides an image forming apparatus for forming an image designated by a job on a sheet fed from one of a plurality of paper feed sources, the image forming apparatus comprising first holding means for holding paper sizes and paper types that are set by a user in one-to-one correspondence with the plurality of paper feed sources, detection means for detecting paper types of sheets respectively fed from the plurality of paper feed sources when the sheets are conveyed, the detection means being provided on a conveyance path used in common for the fed sheets, second holding means for holding the paper types detected by the detection means in one-to-one correspondence with the plurality of paper feed sources, third holding means for holding a paper size designated by the job and a paper type designated by the job or a condition related to setting of a paper type, first selection means for, when the third holding means holds the paper size and the paper type designated by the job, selecting, from among the plurality of paper feed sources, a paper feed source loaded with sheets having the paper size and the paper type designated by the job with reference to the first holding means, second selection means for, when the third holding means holds the condition, selecting, from among the plurality of paper feed sources, a paper feed source that satisfies the condition with reference to the first holding means and/or the second holding means, and control means for performing control to feed a sheet from the paper feed source selected by the first selection means or the second selection means, and form the image designated by the job on the fed sheet.

In another aspect, the present invention provides a method of controlling an image forming apparatus for forming an image designated by a job on a sheet fed from one of a plurality of paper feed sources, the method comprising a first holding step of holding paper sizes and paper types that are set by a user in one-to-one correspondence with the plurality of paper feed sources, a detection step of detecting paper types of sheets respectively fed from the plurality of paper feed sources when the sheets are conveyed, the detection step being performed on a conveyance path used in common for the fed sheets, a second holding step of holding the paper types detected in the detection step in one-to-one correspondence with the plurality of paper feed sources, a third holding step of holding a paper size designated by the job and a paper type designated by the job or a condition related to setting of a paper type, a first selection step of, when the paper size and the paper type designated by the job are held in the third holding step, selecting, from among the plurality of paper feed sources, a paper feed source loaded with sheets having the paper size and the paper type designated by the job with reference to information held in the first holding step, a second selection step of, when the condition is held in the third holding step, selecting, from among the plurality of paper feed sources, a paper feed source that satisfies the condition with reference to information held in the first holding step and/or the second holding step, and a control step of performing control to feed a sheet from the paper feed source selected in the first selection step or the second selection step, and form the image designated by the job thereon.

Further features of the present invention will become apparent from the following description of exemplary embodiments with reference to the attached drawings. Note that the same reference numerals denote the same or similar components throughout the accompanying drawings.

BRIEF DESCRIPTION OF DRAWINGS

The accompanying drawings are incorporated in and constitute a part of the specification, illustrate embodiments of the invention, and, together with the description, serve to explain the principles of the invention.

DESCRIPTION OF EMBODIMENTS

Embodiments of the present invention will now be described hereafter in detail, with reference to the accompanying drawings. It is to be understood that the following embodiments are not intended to limit the claims of the present invention, and that not all of the combinations of the aspects that are described according to the following embodiments are necessarily required with respect to the means to solve the problems according to the present invention.

Figure 1:
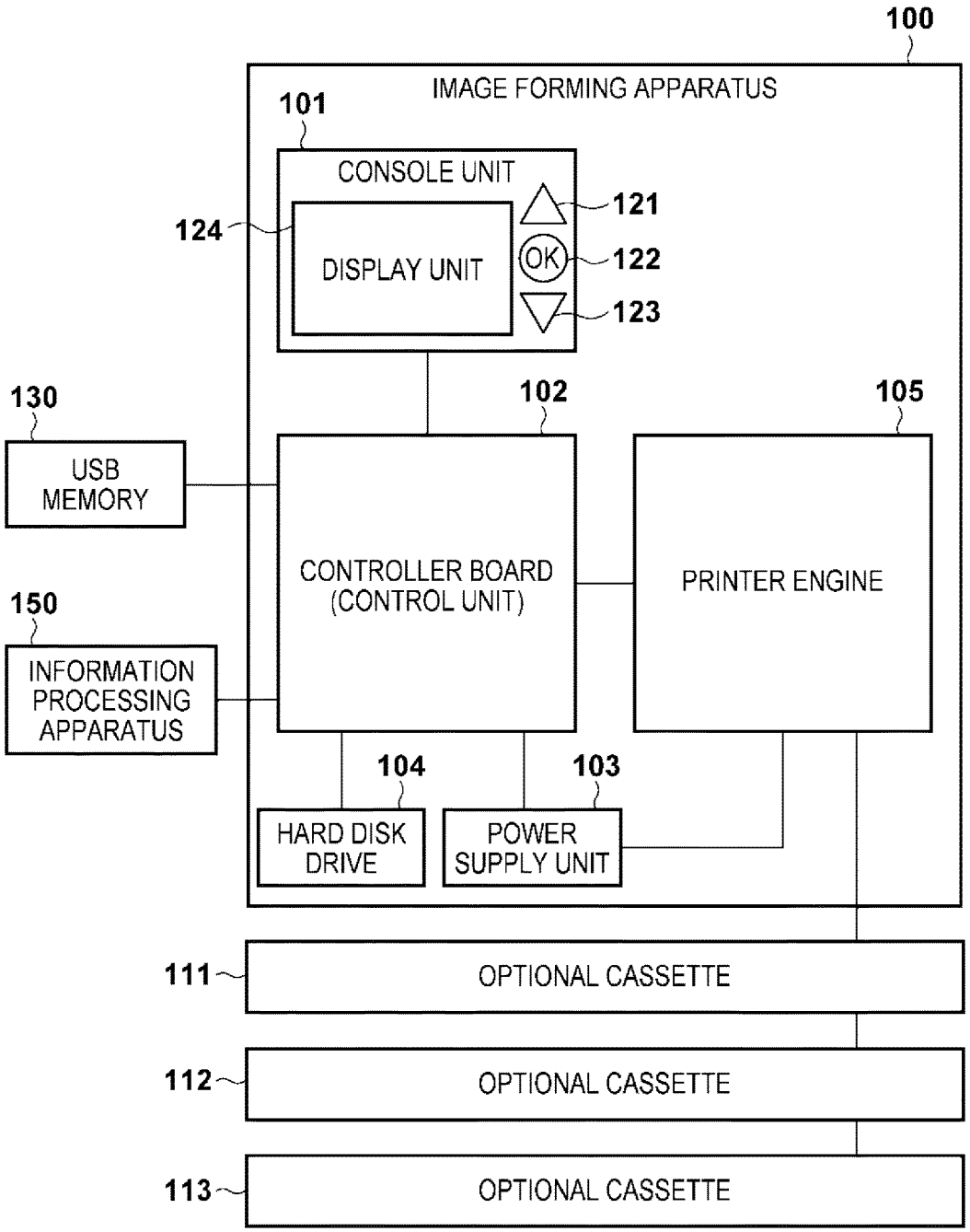
FIG. 1 is a block diagram for explaining a configuration of an image forming apparatus according to embodiments of the present invention.

FIG. 1 is a block diagram for explaining a configuration of an image forming apparatus 100 according to the embodiments of the present invention.

An information processing apparatus 150 is, for example, a personal computer (PC) or a similar computer device, and is connected to the image forming apparatus 100 via a communication interface, such as a local area network (LAN). The information processing apparatus 150 and the image forming apparatus 100 may be directly connected by a network cable, indirectly connected via a network hub, or indirectly connected via the Internet, an intranet, etc. Connection between the image forming apparatus 100 and the information processing apparatus 150 may be wired using a network cable, or may be wireless. An application that runs on the information processing apparatus 150 transmits print settings, such as a paper size and a paper type, and a command for rendering graphics and characters to the image forming apparatus 100 via a printer driver that runs on the information processing apparatus 150. At this time, the printer driver generates a print job on the basis of the print settings and the rendering command, and issues the print job to the image forming apparatus 100.

The image forming apparatus 100 includes a console unit 101, a controller board (control unit) 102, a power supply unit 103, a hard disk drive 104, and a printer engine 105. Furthermore, the image forming apparatus 100 is connected to a plurality of optional paper feed cassettes (optional cassettes) 111, 112, and 113 that are each loaded with sheets. In some cases, the optional cassettes are not provided, or four or more optional cassettes are provided. Paper feed sources may be provided as paper feed cassettes arranged inside the image forming apparatus 100, or may be provided as paper feed decks installed next to a main body of the image forming apparatus 100.

The control unit 102 controls the operations of the entire image forming apparatus 100 by outputting instruction signals to the components of the image forming apparatus 100. The details of the control unit 102 will be described later with reference to FIG. 2.

The console unit 101 receives an instruction issued by a user to the image forming apparatus 100, and notifies the user of the states of the image forming apparatus 100. The console unit 101 includes an up button 121, an OK button 122, and a down button 123 for receiving the instruction, as well as a display panel composed of, for example, a display unit 124 for giving notice of the states. The up button 121 and the down button 123 are operation buttons for instructing a cursor to move up and down on a screen of the display unit 124 so as to change an item indicated by the cursor. The OK button 122 is an operation button for issuing an execution instruction by selecting the item designated by the cursor. For example, when the display unit 124 displays a selection item A, a selection item B, and a selection item C in this order from the top, an item indicated by the cursor is displayed in a highlighted manner so that it can be distinguished from other items that are not indicated by the cursor. Each item is associated with a function of switching from a screen currently displayed on the display unit 124 to another screen, or associated with a function of changing a setting value. When the selection item B is designated by the cursor on the display unit 124, pressing the OK button 122 results in the execution of a function associated with the selection item B. When the selection item B is designated by the cursor on the display unit 124, pressing the up button 121 results in a state in which the selection item A is designated by the cursor, and pressing the OK button 122 in this state results in the execution of a function associated with the selection item A. When the selection item B is designated by the cursor on the display unit 124, pressing the down button 123 results in a state in which the selection item C is designated by the cursor, and pressing the OK button 122 in this state results in the execution of a function associated with the selection item C.

For the sake of simplicity, the description above relates to an example in which the console unit 101 includes the up button 121 and the down button 123 for changing an item and the OK button 122. To carry out the present invention, other input units and output units may be provided in the console unit 101. For example, numeric keys for inputting numeric values may be provided. A touchscreen for receiving an operation instruction that has been issued using a finger or a stylus may be provided. Buttons for moving the cursor left and right may be additionally provided as buttons for changing a selection item. A cancel button for cancelling the act of selection may be additionally provided. Furthermore, for example, means for receiving an operation instruction issued via sound input, and the like, may be provided, an operation result may be pronounced using sound synthesis, and a warning sound may be presented using a buzzer. The console unit 101 may be configured in any manner to carry out the present invention.

The hard disk drive 104 is a storage device for storing main programs. The hard disk drive 104 can also temporarily hold a print job that the control unit 102 has received from the information processing apparatus 150. The hard disk drive 104 can also temporarily hold image data for printing obtained by analyzing and rendering the print job, before the printer engine 105 prints the same on a sheet. The hard disk drive 104 may be realized by, for example, a solid-state drive (SSD) or a similar storage module.

The power supply unit 103 is connected to an AC power supply, and supplies electrical power to the control unit 102 and to the printer engine 105.

The printer engine 105 is a print unit that feeds a sheet from a paper feed source selected in accordance with print settings designated by the control unit 102, and prints image data for printing supplied from the control unit 102 on the sheet. The optional cassettes 111, 112, and 113 are paper feed cassettes that are attached to the main body. The printer engine 105 can control paper feeding from the optional cassettes 111, 112, and 113, and operates integrally with the image forming apparatus 100. Details of the optional cassettes 111, 112, and 113 will be described later with reference to FIGS. 3A and 3B.

A USB memory 130 is a storage device that can store, for example, a print job. Print processing may be executed on the basis of a print job stored in the USB memory 130 in response to a print instruction issued by the user via the console unit 101. In this case, the image forming apparatus 100 generates a print job on the basis of print settings configured by the user via the console unit 101. The image forming apparatus 100 according to the present embodiments is not limited to a printer specialized in print functions, and may be a digital multi-functional peripheral having scanner functions, facsimile functions, and the like.

The control unit 102 and the printer engine 105 may be arranged in separate bodies. That is to say, they may compose an image forming system including a printer server. A part of the functions performed by the control unit 102 may be performed by a server of a cloud service. The information processing apparatus 150 may perform functions equivalent to the functions of the control unit 102, and the image forming apparatus 100 may be specialized in control over the printer engine 105 (a so-called host-based print system).

Figure 2:
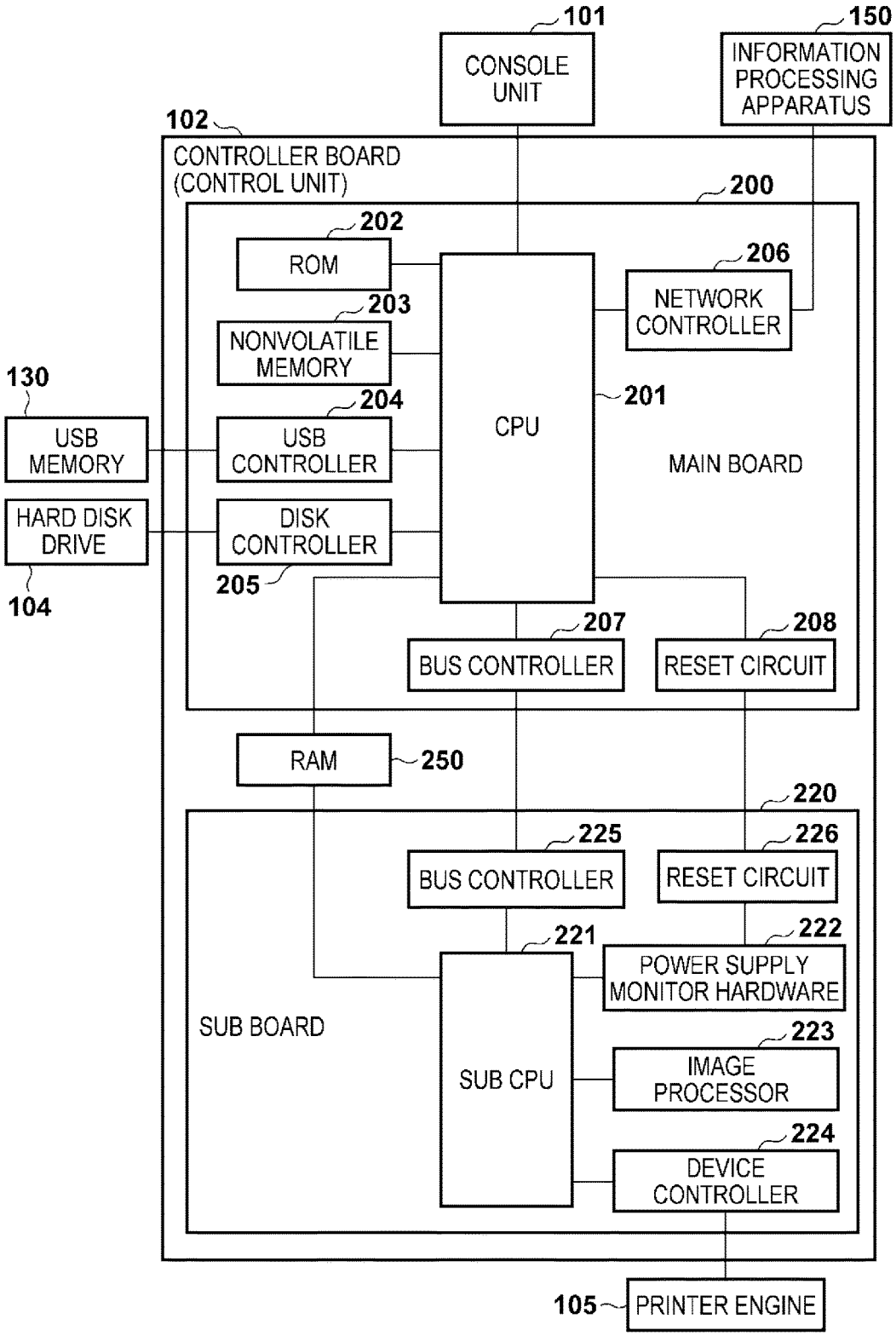
FIG. 2 is a block diagram for explaining a hardware configuration of a controller board in the image forming apparatus according to the present embodiments.

FIG. 2 is a block diagram for describing a hardware configuration of the control unit 102 in the image forming apparatus 100 according to the present embodiments. A main board 200 and a sub board 220 include a large number of items of peripheral hardware for CPUs, including a chipset, a bus bridge, and a clock generator. As a description of such hardware is complicated, however, the figure is presented in a simplified form.

The control unit 102 includes the main board 200, the sub board 220, and a RAM 250.

First, a configuration of the main board 200 will be described below.

The main board 200 includes a CPU 201, a ROM 202, a nonvolatile memory 203, a USB controller 204, a disk controller 205, a network controller 206, a bus controller 207, and a reset circuit 208.

The CPU 201 is a central processing unit for controlling the modules included in the main board 200. The ROM 202 stores a boot program for the CPU 201. When the image forming apparatus 100 is powered ON, the CPU 201 reads out the boot program stored in the ROM 202, executes the boot program, reads out an OS and a main program from the hard disk drive 104, deploys the OS and the main program to the RAM 250, and executes the main program.

The nonvolatile memory 203 stores setting information of the image forming apparatus 100, counter information related to printing, and the like. The nonvolatile memory 203 holds information even when the image forming apparatus 100 is in a power-OFF state. Therefore, upon the power-ON, the CPU 201 can retrieve, from the nonvolatile memory 203, information that was effective before the power-OFF.

The USB controller 204 controls communication with a device connected via the Universal Serial Bus. In the present embodiments, the USB controller 204 controls input and output of data with respect to the USB memory 130. Alternatively, when the information processing apparatus 150 and the image forming apparatus 100 are connected via a USB cable, the image forming apparatus 100 may operate as a peripheral device for the information processing apparatus 150 by controlling input/output via the USB controller 204.

The disk controller 205 controls input and output of data between the CPU 201 and the hard disk drive 104. The network controller 206 performs input and output of data with respect to the information processing apparatus 150 via a network cable. As stated earlier, connection between the network controller 206 and the information processing apparatus 150 may be wired or wireless. The bus controller 207 functions as a bridge to a bus controller 225 in the sub board 220. The reset circuit 208 resets hardware of the main board 200 when the image forming apparatus 100 is powered ON.

Next, a configuration of the sub board 220 will be described below.

The sub board 220 includes a sub CPU 221, power supply monitor hardware 222, an image processor 223, a device controller 224, the bus controller 225, and a reset circuit 226.

The sub CPU 221 is a central processing unit for controlling the modules included in the sub board 220. The power supply monitor hardware 222 monitors a supply of electrical power to the image forming apparatus 100. When the sub CPU 221 is in a normally operable state, the power supply monitor hardware 222 can reset the entire image forming apparatus 100 via the reset circuits 226 and 208 in accordance with an instruction from the sub CPU 221. When no electrical power is supplied to the sub CPU 221, the power supply monitor hardware 222 can supply electrical power to the control unit 102 in accordance with activation of a power supply switch (not shown) of the image forming apparatus 100. The power supply monitor hardware 222 may be realized by, for example, a smaller-scale circuit run by another CPU.

The reset circuit 226 resets hardware of the sub board 220. The image processor 223 executes digital image processing in real time. For example, the image processor 223 executes image processing for converting DisplayList (intermediate data) obtained through analysis of a print job by a print job analyzer 404 (FIG. 4) into a contone image. On the basis of the contone image, the image processor 223 also executes image processing, such as dithering processing for generating halftone image data that can be printed by the printer engine 105. The image processor 223 also executes processing for rearranging pieces of image data in accordance with a frame sequential method. The image processor 223 may also execute image processing for adjusting the contone image to shades of color desirable for the user. The image processor 223 can be realized by an application-specific integrated circuit (ASIC). Alternatively, the image processor 223 can be realized by a field-programmable gate array (FPGA).

The embodiments are described under the assumption that the image processor 223 executes digital image processing in real time. Alternatively, the CPU 201 and the sub CPU 221 may execute a part or an entirety of such image processing.

The device controller 224 controls the printer engine 105. The bus controller 225 functions as a bridge to the bus controller 207 in the main board 200. The CPU 201 and the sub CPU 221 can share and exchange various types of information via the bus controllers 207 and 225.

The RAM 250 is a main storage memory that can be accessed by the CPU 201 and the sub CPU 221. When the image forming apparatus 100 is powered ON, the CPU 201 executes the boot program in the ROM 202, and deploys, to the RAM 250, programs for the CPU 201 and the sub CPU 221 stored in the hard disk drive 104. The CPU 201 and the sub CPU 221 realize the functions of the image forming apparatus 100 by executing their respective programs deployed into the RAM 250. The RAM 250 is also used as a temporary working memory in executing programs, including an initial program.

Although the CPU 201 and the sub CPU 221 share the RAM 250 in the present embodiments, the CPU 201 and the sub CPU 221 may be provided with their respective dedicated RAMs to which programs to be executed are deployed.

In the description of the present embodiments, the main board 200 includes the nonvolatile memory 203, the USB controller 204, the disk controller 205, and the network controller 206. Alternatively, a part or all of the interfaces included in the main board 200 may be provided in the sub board 220. Alternatively, the main board 200 may realize all of the functions of the sub board 220, and the CPU 201 may perform the functions realized by the sub board 220 in place of the sub CPU 221.

Figure 3A:
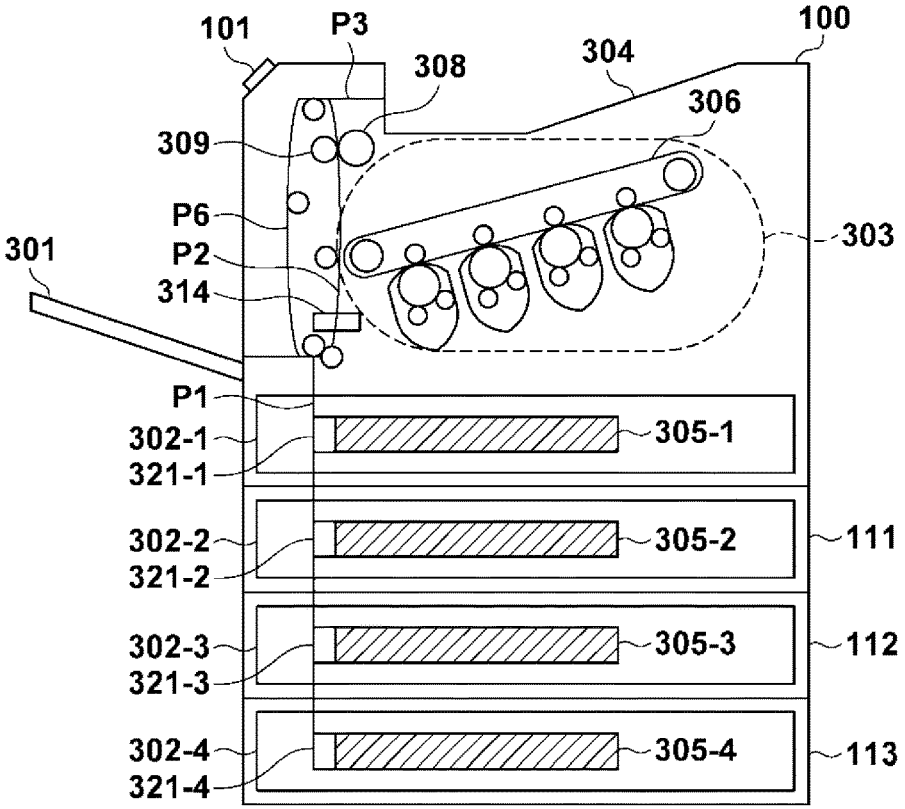
FIG. 3A depicts a simplified cross-sectional view illustrating a configuration of a printer engine in the image forming apparatus according to the embodiments.
Figure 3B:
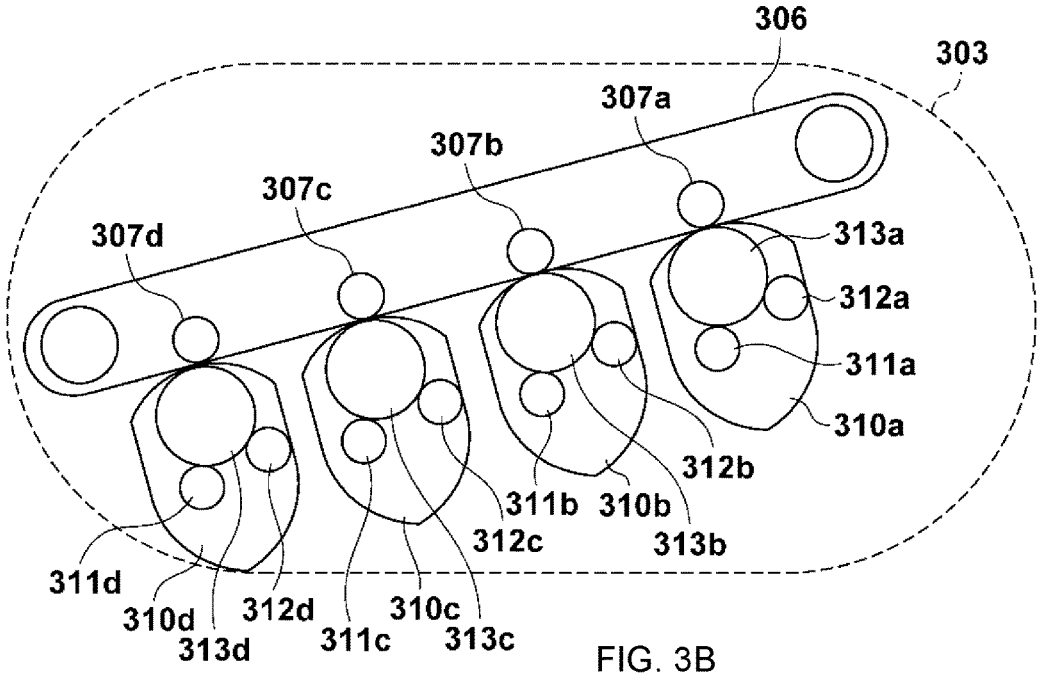
FIG. 3B depicts a simplified cross-sectional view illustrating a configuration of a printer engine in the image forming apparatus according to the embodiments.

FIGS. 3A and 3B depict simplified cross-sectional views illustrating a configuration of the printer engine 105 in the image forming apparatus 100 according to the embodiments. FIG. 3A depicts a cross-sectional view of the image forming apparatus 100 and the optional cassettes 111 to 113. FIG. 3A shows the overall configuration of the image forming apparatus 100, and FIG. 3B depicts an enlarged view of an image forming unit 303. The image forming apparatus 100 according to the present embodiments will be described as an image forming apparatus that can form a color image using four colors of toner (yellow, magenta, cyan, and black). Alternatively, the image forming apparatus 100 may be an image forming apparatus that can perform monochrome printing using one color of toner (black). Alternatively, the image forming apparatus 100 may be an image forming apparatus that can achieve color representation in a richer color space using other colors of toner (red, blue, gray, etc.) in combination. Alternatively, the image forming apparatus 100 may be an image forming apparatus that can give a surface of a printed product a wide variety of textures using clear toner.

First, the overall configuration of the image forming apparatus 100 will be described below with reference to FIG. 3A.

The optional cassettes 111 to 113 are attached to the image forming apparatus 100 that includes a manual feed tray 301, a paper feed cassette 302-1, and a paper discharge tray 304. The optional cassettes 111 to 113 include paper feed cassettes 302-2 to 302-4, respectively, and sheets 305-1 to 305-4 are loaded in the paper feed cassettes 302-1 to 302-4, respectively. In the present embodiments, the optional cassettes 111 to 113 are integrated with the image forming apparatus 100, and the paper feed cassette 302-1 and the paper feed cassettes 302-2 to 302-4 are treated as equivalents. The paper feed cassettes 302-1 to 302-4 are provided with remaining paper amount sensors 321-1 to 321-4, respectively.

The image forming apparatus 100 includes the image forming unit 303 that forms an image on a sheet using toner through an electrophotographic process, and a fixing unit for fixing a toner image to the sheet using a fixing roller 308 and a pressing roller 309 provided therein.

In the case of single-sided printing, a sheet fed from one of the paper feed cassettes 302-1 to 302-4 is conveyed along conveyance paths P1, P2, and P3, in this order. In the case of double-sided printing, the sheet is first conveyed along the conveyance paths P1 to P3, in this order, to form an image on a first surface of the sheet, and, after the conveyance path P3, the sheet is conveyed in a reverse direction along the conveyance paths P6, P2, and P3, in this order, to form an image on a second surface of the sheet, and then, the sheet is discharged to the outside of the image forming apparatus 100. On the conveyance path P2 used in common, a media sensor 314 detects, for example, the smoothness of a surface of the sheet, and a reflected light amount or a transmitted light amount on the surface of the sheet.

Next, the components of the image forming unit 303 will be described below with reference to FIG. 3B.

Toner cartridges 310*a* to 310*d* correspond to yellow, magenta, cyan, and black, respectively. The letters a to d are appended to reference numerals of components corresponding to yellow, magenta, cyan, and black, respectively. For example, the toner cartridge 310*a* includes a charger provided with a charging roller 311*a*, a developer provided with a developing roller 312*a*, and a photosensitive drum 313*a*. A latent image is formed on the photosensitive drum 313*a* using laser light that has been modulated on the basis of yellow image data transmitted from the control unit 102. The developer applies yellow toner to the photosensitive drum 313*a* on which the latent image based on the yellow image data has been formed to develop the latent image. The toner cartridges 310*b* to 310*d* corresponding to other colors similarly form latent images and toner images of corresponding colors, and thus, a description thereof is omitted.

An overview of control performed by the printer engine 105 during printing will now be described.

In accordance with an instruction from the control unit 102, the printer engine 105 develops image data of each color transmitted from the control unit 102 on the corresponding one of photosensitive drums 313*a* to 313*d*, and primary-transfers the developed images onto an intermediate transfer belt 306 in sequence. Primary transfer rollers 307*a* to 307*d* are used to primary-transfer toner images of corresponding colors onto the intermediate transfer belt 306. The printer engine 105 feeds a sheet from one of the paper feed cassettes 302-1 to 302-4, and, following the primary transfer of the toner images onto the intermediate transfer belt 306, secondary-transfers the toner images onto the sheet that is being conveyed along the conveyance path P2 via the conveyance path P1. Once the toner images have been transferred onto the sheet, the printer engine 105 conveys the sheet to the fixing unit provided with the fixing roller 308 and the pressing roller 309, so as to fix the toner images to the sheet. The printer engine 105 finally discharges the sheet to which the toner images have been fixed to the discharge tray 304 via the conveyance path P3. The printer engine 105 can also detect remaining amounts of sheets loaded in the paper feed cassettes 302-1 to 302-4 using the remaining paper amount sensors 321-1 to 321-4.

A description is now given of the media sensor 314.

The media sensor 314 detects, for example, the smoothness of a surface of a sheet located on the conveyance path P2, and a reflected light amount or a transmitted light amount of the sheet. On the basis of the result of detection by the media sensor 314, the sub CPU 221 specifies the type of the sheet passing the conveyance path P2 (plain paper, thick paper, glossy paper, or the like). Specifically, the sub CPU 221 in the sub board 220 obtains the characteristics of the sheet detected by the media sensor 314 via the device controller 224, specifies the type of the sheet, and notifies the control unit 102 of the type of the sheet. Information of the type of the sheet can be used as control information for the image forming unit 303, the fixing roller 308, and the pressing roller 309. The present invention can be carried out using another sensor that can specify or estimate the type of the sheet as the media sensor 314. Processing for specifying the type of the sheet may be executed by the CPU 201 or the sub CPU 221, or a dedicated CPU may be provided for the media sensor 314.

Figure 4:
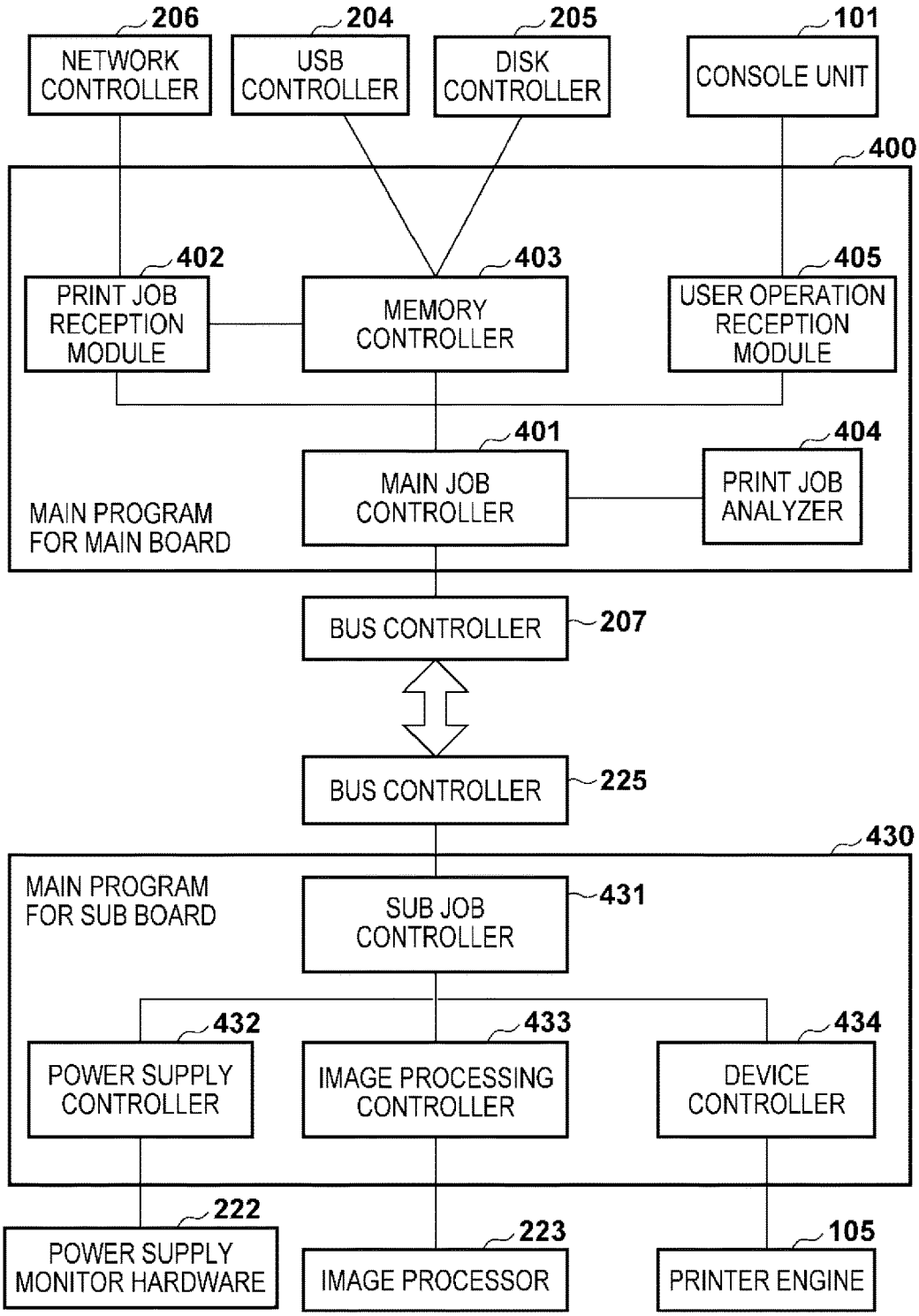
FIG. 4 depicts a view for describing structures of software modules included in main programs executed by a CPU and a sub CPU according to the embodiments.

FIG. 4 shows a view for describing structures of software modules included in the main programs executed by the CPU 201 and the sub CPU 221 according to the embodiments. The CPU 201 executes a main program 400 for the main board deployed to the RAM 250, and the sub CPU 221 executes a main program 430 for the sub board deployed to the RAM 250.

The main program 400 for the main board includes a main job controller 401, a print job reception module 402, a memory controller 403, the print job analyzer 404, and a user operation reception module 405.

Figure 7A:
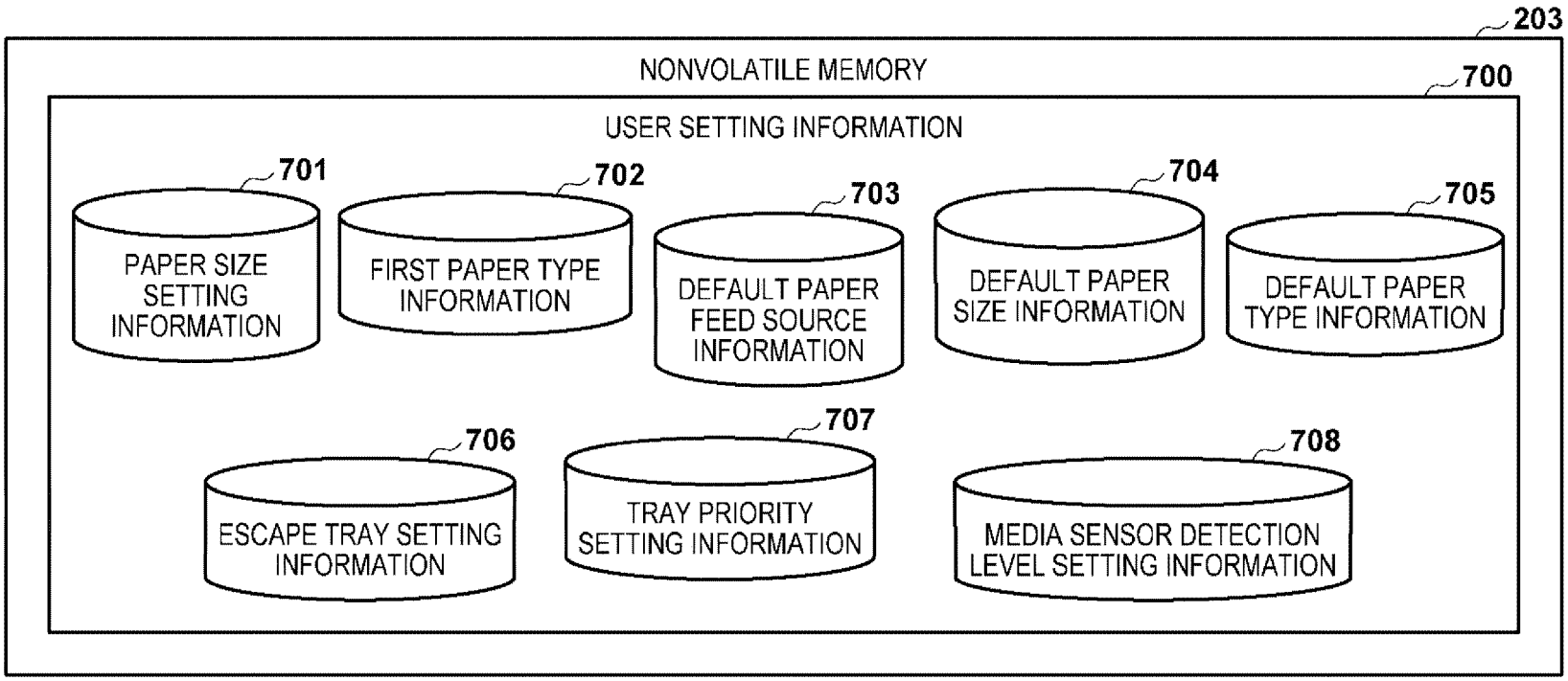
FIG. 7A depicts a view for describing information stored in a hard disk device, a nonvolatile memory, and a RAM in the image forming apparatus according to the embodiments.

The main job controller 401 is a control module for controlling the software modules necessary for executing a print job. The main job controller 401 notifies the modules of necessary information, and communicates with the main program 430 for the sub-board via the bus controller 207. The print job reception module 402 receives the print job from the network controller 206 or the memory controller 403, and stores the print job to the hard disk drive 104 via the memory controller 403. The memory controller 403 controls the USB controller 204 and the disk controller 205 to control transmission and reception of data to and from the storage devices. The print job analyzer 404 analyzes the print job, and stores the result of the analysis to print job information 750 (FIG. 7C) and print page information 760 (FIG. 7C). The user operation reception module 405 receives an operation for setting information, such as paper sizes and paper types corresponding to the paper feed sources, and updates user setting information 700 (FIG. 7A).

The main program 430 for the sub board includes a sub job controller 431, a power supply controller 432, an image processing controller 433, and a device controller 434. The sub job controller 431 controls the software modules necessary for executing the print job, notifies the modules of necessary information, and communicates with the main program 400 for the main board via the bus controller 225. The power supply controller 432 controls the power supply monitor hardware 222. The image processing controller 433 controls the image processor 223 to generate image data for printing. The device controller 434 controls the printer engine 105 to perform printing on a sheet.

Although the device controller 434 is controlled using the main program 430 for the sub board in the present embodiments, the present invention may be realized by providing the printer engine 105 with a dedicated CPU to communicate with the device controller 434. The present embodiments includes an exemplary configuration of the image forming apparatus 100, and correspondence between the exemplary configuration and components, such as mounted CPUs, of the image forming apparatus 100 is not limited to this embodiment of the present invention.

Figure 5A:
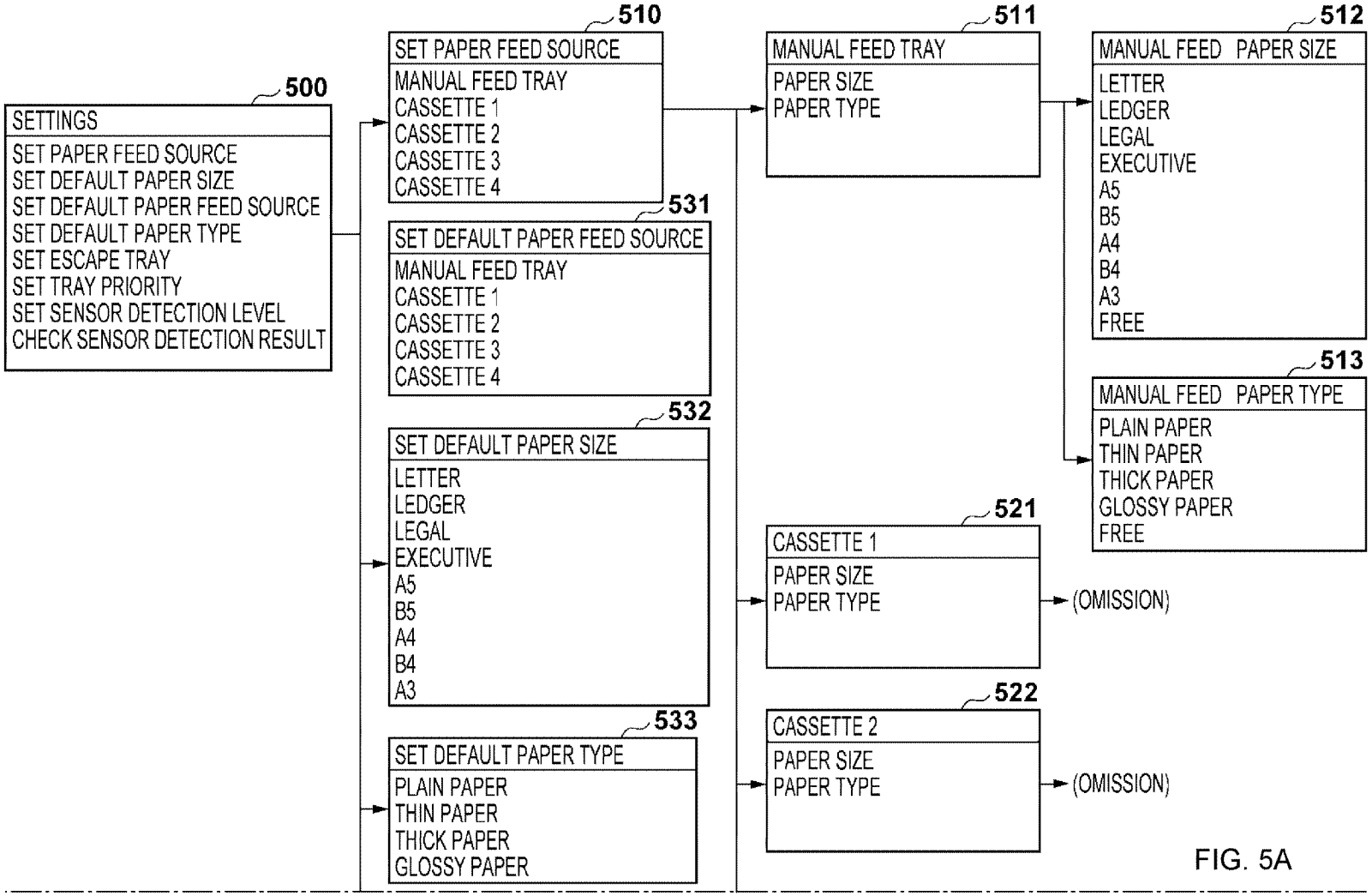
FIG. 5A is a schematic diagram showing menu items displayed on a console unit in the image forming apparatus according to the embodiments.
Figure 5B:
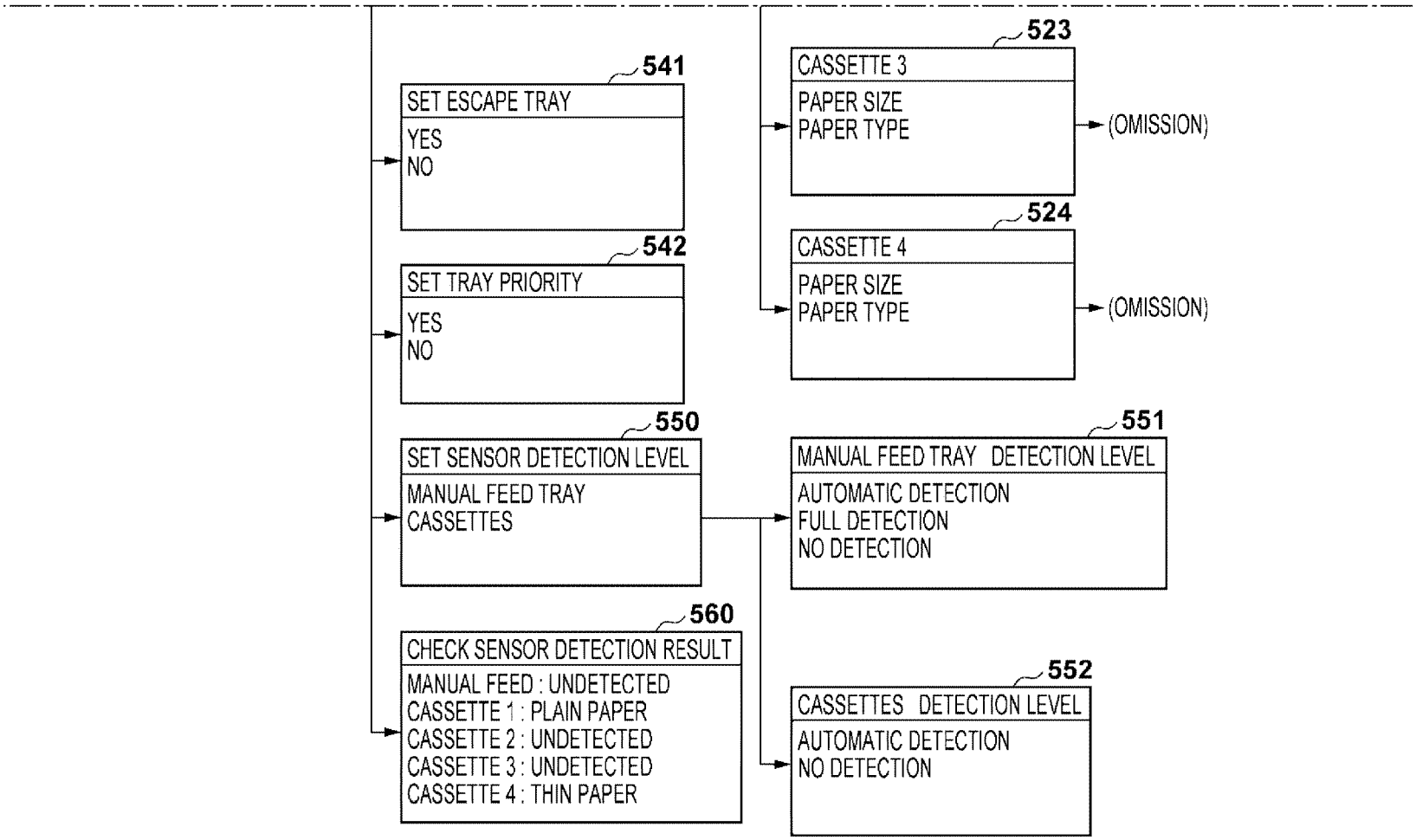
FIG. 5B is a schematic diagram showing menu items displayed on a console unit in the image forming apparatus according to the embodiments.

FIGS. 5A and 5B are schematic diagrams showing menu items to be displayed on the console unit 101 in the image forming apparatus 100 according to the embodiments.

These menu items are mainly used to change the user setting information 700 (FIG. 7A) stored in the nonvolatile memory 203.

Figure 7B:
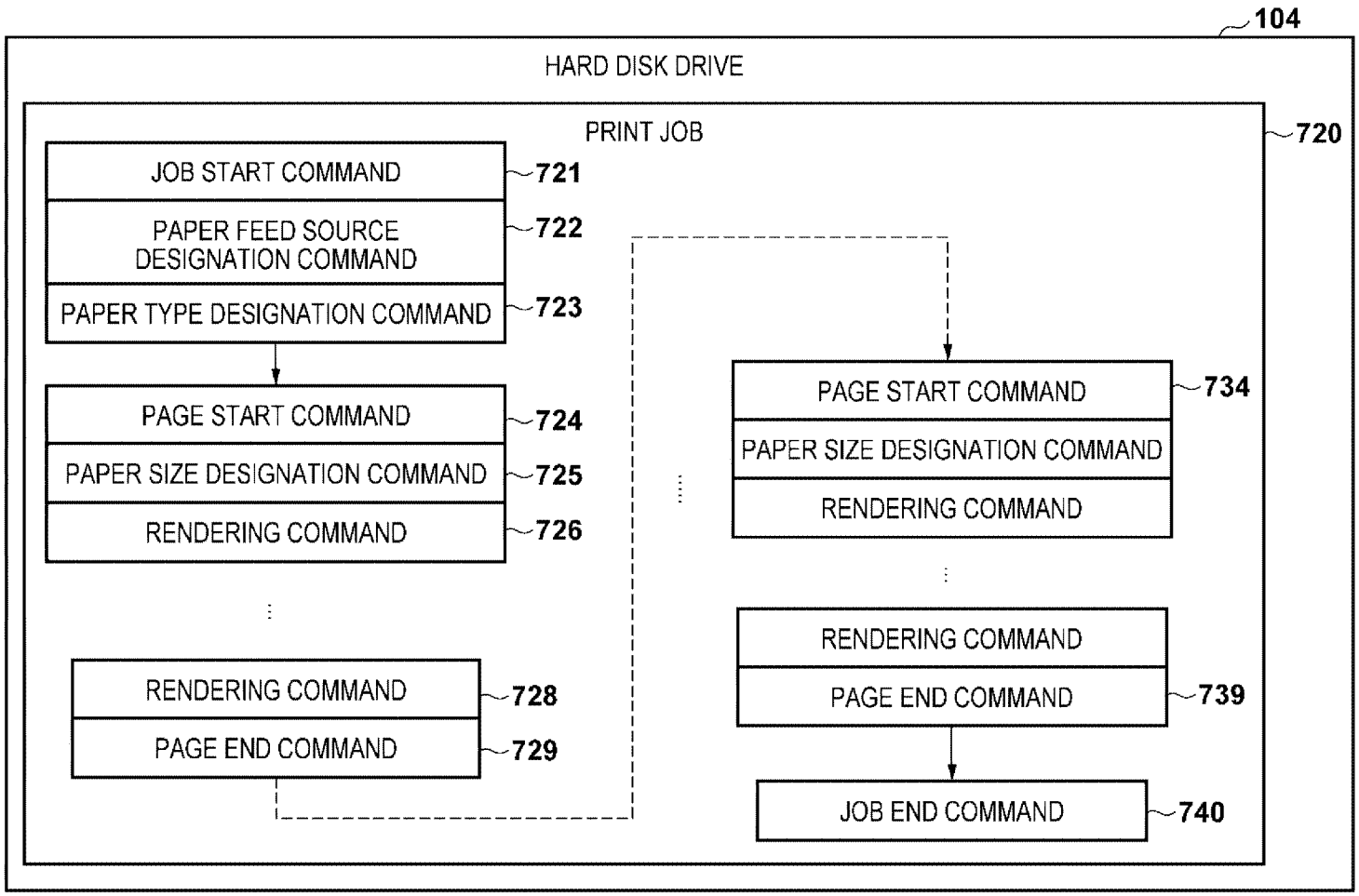
FIG. 7B depicts a view for describing information stored in a hard disk device, a nonvolatile memory, and a RAM in the image forming apparatus according to the embodiments.
Figure 7C:
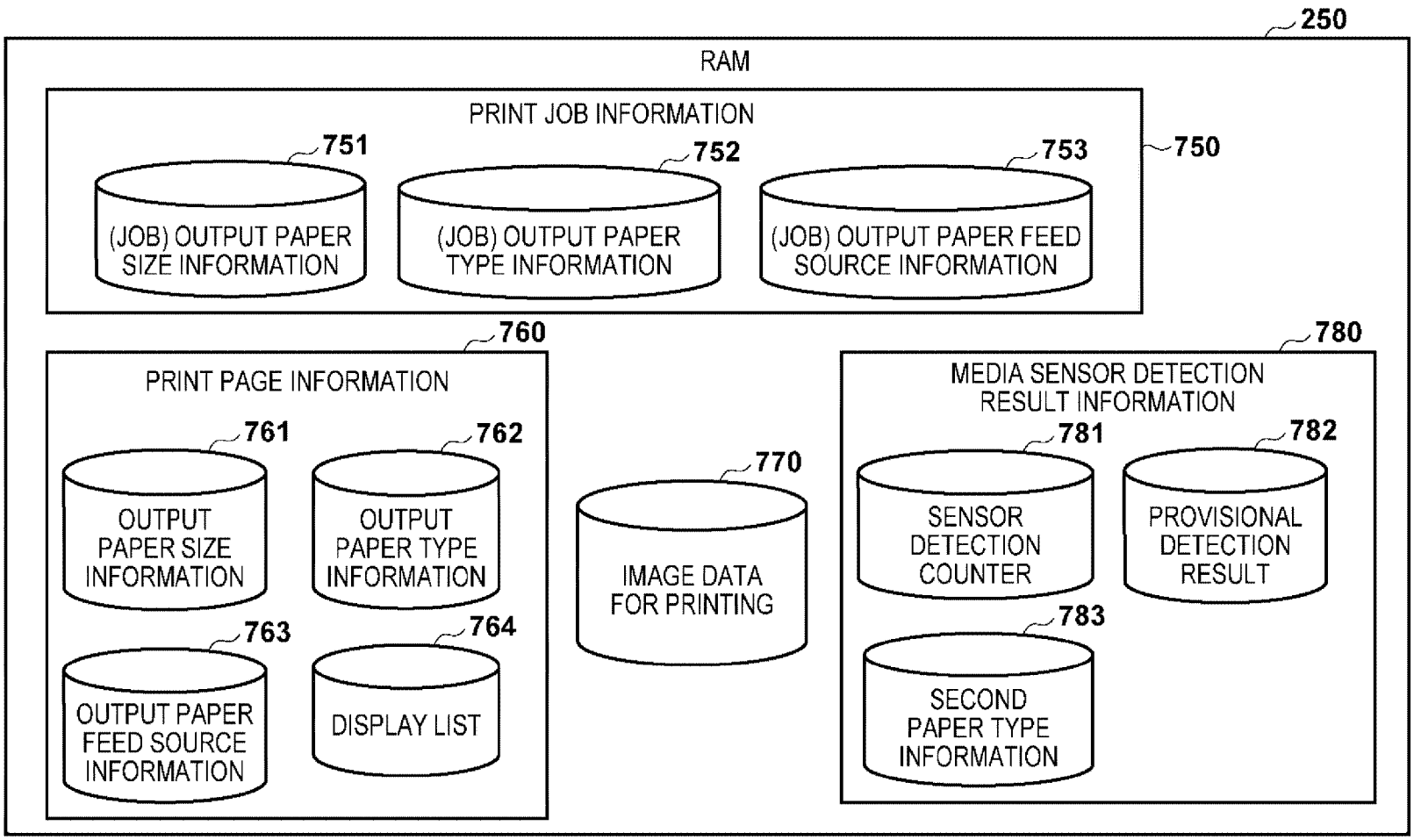
FIG. 7C depicts a view for describing information stored in a hard disk device, a nonvolatile memory, and a RAM in the image forming apparatus according to the embodiments.

FIGS. 7A through 7C depict views for describing information stored in the hard disk drive 104, the nonvolatile memory 203, and the RAM 250 in the image forming apparatus 100 according to the embodiments.

Various network settings may be configurable to allow the network controller 206 to connect to the Internet and the intranet, although a description thereof is omitted. Due to the physical restrictions on the console unit 101, all or only a part of menu screens is displayed in practice. For example, when the console unit can display only five rows at a time, only the top title row and four rows of selection items are displayed.

A setting menu screen 500 enables selection from a list of setting items. The setting menu screen 500 includes "set paper feed source," "set default paper size," "set default paper feed source," and "set default paper type." The setting menu screen 500 also includes "set escape tray," "set tray priority," "set sensor detection level," and "check sensor detection result".

"Set paper feed source" is associated with a function of displaying a paper feed source setting screen 510. The paper feed source setting screen 510 enables selection of one of the manual feed tray and paper feed cassettes 1 to 4 (corresponding to the paper feed cassettes 302-1 to 302-4 in FIG. 3A) as a paper feed source to be set. The details thereof will be described later.

"Set default paper size" is associated with a function of displaying a default paper size setting screen 532. The default paper size setting screen 532 enables selection and setting of a default paper size from among the paper sizes shown in FIGS. 5A and 5B.

"Set default paper feed source" is associated with a function of displaying a default paper feed source setting screen 531. The default paper feed source setting screen 531 enables selection of one of the manual feed tray and the paper feed cassettes 1 to 4 (corresponding to the paper feed cassettes 302-1 to 302-4 in FIG. 3A) as a default paper feed source.

"Set default paper type" is associated with a function of displaying a default paper type setting screen 533. The default paper type setting screen 533 enables a paper type selected from among plain paper, thin paper, thick paper, and glossy paper to be set as a default paper type.

"Set escape tray" is associated with a function of displaying an escape tray setting screen 541. On the escape tray setting screen 541, whether to set an escape tray ("yes") or not ("no") can be selected and configured.

"Set tray priority" is associated with a function of displaying a tray priority setting screen 542. On the tray priority setting screen 542, whether to set a prioritized tray ("yes") or not ("no") can be selected and configured.

"Set sensor detection level" is associated with a function of displaying a sensor detection level setting screen 550. The sensor detection level setting screen 550 enables setting of detection levels of the sensor with respect to the manual feed tray and the cassettes.

"Check sensor detection result" is associated with a function of displaying a sensor detection result check screen 560. The sensor detection result check screen 560 displays the results of detection by the sensor with respect to the manual feed tray and the paper feed cassettes 1 to 4.

A description is now given of the paper feed source setting screen 510.

The paper feed source setting screen 510 includes items corresponding to the manual feed tray and the cassettes 1 to 4, and enables one of the cassettes 1 to 4 to be selected. The number of displayed selection items increases or decreases on the basis of the connection states of the optional paper feed cassettes. For example, when no optional cassette is connected, only "manual feed tray" and "cassette 1" are displayed. When four optional cassettes are connected, the paper feed source setting screen 510 additionally displays "cassette 5".

"Manual feed tray" is associated with a function of displaying a manual feed tray setting screen 511, and "cassette 1" to "cassette 4" are associated with setting screens 521 to 524 for the cassettes 1 to 4, respectively. The manual feed tray setting screen 511 enables selection and setting of the size and the type of sheets set in the manual feed tray. Upon selection of "paper size" on the manual feed tray setting screen 511, a manual feed paper size setting screen 512 is displayed. On the other hand, upon selection of "paper type" on the manual feed tray setting screen 511, a manual feed paper type setting screen 513 is displayed.

The manual feed paper size setting screen 512 enables the user to select and set the size of sheets set in the manual feed tray. The manual feed paper size setting screen 512 includes selection items corresponding to the sizes of sheets that can be fed from the manual feed tray, as well as an item "free." These selection items are associated with a function of rewriting the setting corresponding to the manual feed tray in the paper size setting information 701 (FIG. 7A) in accordance with the item selected on this screen. "Free" means that the size is not specified, and when "free" is set, the manual feed tray can be selected as a paper feed source regardless of the size of sheets that are actually set therein. For example, upon selection of an item "A4," the setting corresponding to the manual feed tray in the paper size setting information 701 is rewritten to "A4." The same goes for other paper sizes.

The manual feed paper type setting screen 513 enables the user to set the type of sheets set in the manual feed tray. The manual feed paper type setting screen 513 includes selection items corresponding to the types of sheets that can be fed from the manual feed tray, as well as an item "free." These selection items are associated with a function of rewriting the setting corresponding to the manual feed tray in first paper type information 702 (FIG. 7A) in accordance with the item selected on this screen. "Free" means that the type is not specified, and when "free" is set, the manual feed tray can be selected as a paper feed source regardless of the type of sheets that are actually set therein. Note that in the present embodiments, whether printing can be performed is determined in accordance with the results of detection by the media sensor 314 with respect to a paper feed source for which the media sensor 314 is effective. For example, upon selection of "plain paper," the setting corresponding to the manual feed tray in the first paper type information 702 is rewritten to "plain paper." The same goes for other paper types.

Although the setting screens 521 to 524 for the cassettes and the manual feed tray setting screen 511 target different paper feed sources, they are basically similar. For the sake of simplicity, the cassettes 1 to 4 will be described as a cassette N in the following description.

Upon selection of "paper size" on a cassette N setting screen, a cassette N paper size setting screen is displayed. Upon selection of an item corresponding to a paper size on the cassette N paper size setting screen, the paper size corresponding to the cassette N in the paper size setting information 701 (FIG. 7A) is rewritten in accordance with the item set on this screen. On the other hand, upon selection of "paper type" on a cassette N setting screen, a cassette N paper type setting screen is displayed. Upon selection of an item corresponding to a paper type on the cassette N paper type setting screen, the setting corresponding to the cassette N in the first paper type information 702 is rewritten in accordance with the paper type selected on this screen.

The default paper feed source setting screen 531 enables setting of a default paper feed source. The default paper feed source setting screen 531 includes items corresponding to the manual feed tray, the paper feed cassette (cassette 1), and the optional cassettes 111 to 113 (cassettes 2 to 4) of the image forming apparatus 100. Upon selection of one of the paper feed sources on the default paper feed source setting screen 531, default paper feed source information 703 is rewritten to the paper feed source selected on this screen.

The default paper size setting screen 532 enables setting of a default paper size. The default paper size setting screen 532 includes items corresponding to the sizes of sheets that can be printed by the printer engine 105. Upon selection of one of the items on the default paper size setting screen 532, default paper size information 704 is rewritten to the paper size selected on this screen.

The default paper type setting screen 533 enables setting of a default paper type. The default paper type setting screen 533 includes items corresponding to the types of sheets that can be printed by the printer engine 105. Upon selection of one of the items on the default paper type setting screen 533, default paper type information 705 is rewritten to the selected paper type.

The escape tray setting screen 541 enables the manual feed tray to be set as a paper feed source when the manual feed tray is excluded from candidates for automatic paper feed source selection but no paper feed source is found to satisfy the conditions for the automatic paper feed source selection. The escape tray setting screen 541 includes items "yes" and "no." Escape tray setting information 706 (FIG. 7A) is rewritten to "yes" upon selection of the item "yes," and the escape tray setting information 706 is rewritten to "no" upon selection of the item "no".

On the tray priority setting screen 542, whether to prioritize the manual feed tray as a candidate for the automatic paper feed source selection can be set. The tray priority setting screen 542 includes "yes" and "no." Tray priority setting information 707 (FIG. 7A) is rewritten to "yes" upon selection of the item "yes," and the tray priority setting information 707 is rewritten to "no" upon selection of the item "no".

The sensor detection level setting screen 550 enables selection of a paper feed source for which a sensor detection level is to be set. The sensor detection level setting screen 550 includes "manual feed tray" and "cassettes." An item corresponding to the manual feed tray is associated with a function of displaying a manual feed tray detection level screen 551, and an item corresponding to the cassettes is associated with a function of displaying a cassette detection level screen 552.

On the manual feed tray detection level screen 551, whether to execute processing for detecting the paper type of a sheet fed from the manual feed tray using the media sensor can be set. The manual feed tray detection level screen 551 includes "automatic detection," "full detection," and "no detection" as selection items. Upon selection of "automatic detection," the setting related to the manual feed tray in media sensor detection level setting information 708 (FIG. 7A) is rewritten to "automatic detection." Upon selection of "full detection," the setting related to the manual feed tray in the media sensor detection level setting information 708 is rewritten to "full detection." Upon selection of "no detection," the setting related to the manual feed tray in the media sensor detection level setting information 708 is rewritten to "no detection." In addition, at the same time as the change in the setting, information corresponding to the manual feed tray in second paper type information is initialized to "undetected".

Although the detection levels of the media sensor can be set with respect to "manual feed tray" and "cassettes" in the description of the present embodiments, the detection level of the media sensor may be set, for example, on a cassette-by-cassette basis.

On the cassette detection level screen 552, whether to execute processing for detecting the paper type of a sheet fed from each cassette using the media sensor can be set. The cassette detection level screen 552 includes "automatic detection" and "no detection." Upon selection of "automatic detection," the setting corresponding to the cassettes in the media sensor detection level setting information 708 is rewritten to "automatic detection." Upon selection of "no detection," the setting corresponding to the cassettes in the media sensor detection level setting information 708 is rewritten to "no detection." In addition, at the same time as the change in the setting, information corresponding to the cassettes in the second paper type information is initialized to "undetected."

The sensor detection result check screen 560 enables the user to check the paper types detected by the media sensor, and displays, to the user, the second paper type information in correspondence with each of the paper feed sources including the manual feed tray. For example, the sensor detection result check screen 560 indicates that the media sensor has not detected the paper type of sheets loaded in the manual feed tray, and that the media sensor has detected plain paper as the paper type of sheets loaded in the cassette 1. The sensor detection result check screen 560 also indicates that the paper types of sheets loaded in the cassettes 2 and 3 have not been detected, and that thin paper has been detected as the paper type of sheets loaded in the cassette 4.

Figure 6A:
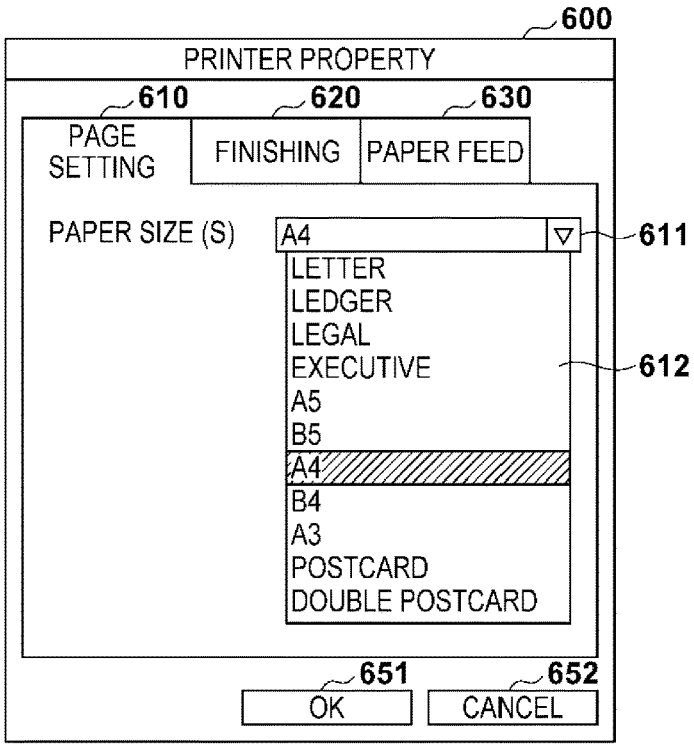
FIG. 6A depicts a view illustrating an example of a print setting screen displayed by a printer driver that runs on an information processing apparatus according to the embodiments.
Figure 6B:
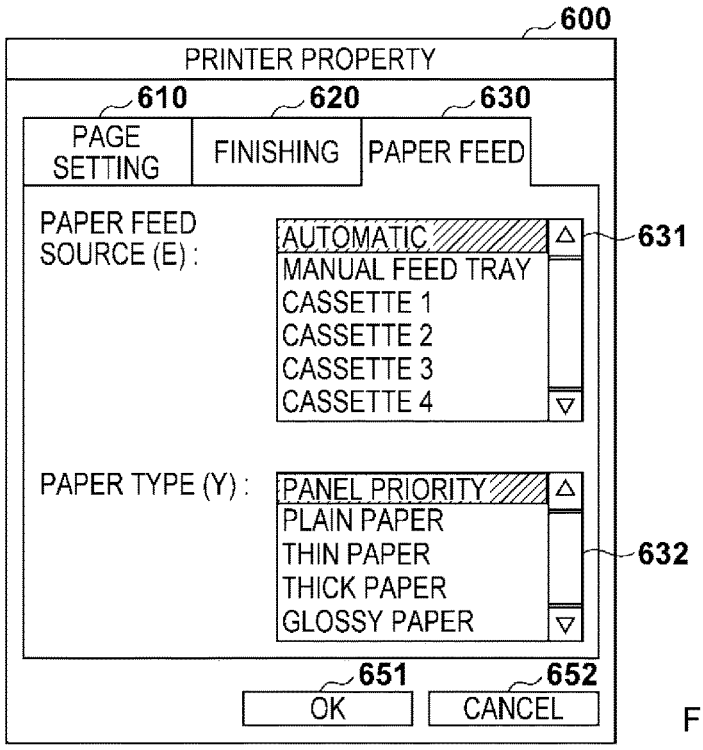
FIG. 6B depicts a view illustrating an example of a print setting screen displayed by a printer driver that runs on an information processing apparatus according to the embodiments.

FIGS. 6A and 6B show examples of a print setting screen displayed by the printer driver that runs on the information processing apparatus 150 according to the embodiments.

The printer driver is called up by an application that runs on the information processing apparatus 150. A printer driver UI 600 represents an example of a print setting screen displayed by the printer driver. The printer driver UI 600 includes a page setting tab 610, a finishing tab 620, a paper feed tab 630, an OK button 651, and a cancel button 652. The user can switch between displayed setting items by selecting a tab on the printer driver UI 600.

FIG. 6A shows a state in which a paper size pull-down menu 611 is displayed as a result of the user selecting the page setting tab 610, and a paper size list 612 in the paper size pull-down menu 611 is also displayed. When the user selects a paper size to be used in printing from the paper size list 612, the content of the paper size pull-down menu 611 is changed to the selected paper size. In FIG. 6A, the A4 size is selected.

The finishing tab 620 includes a menu for setting color correction parameters to be used in printing. The details thereof are not described as a description of the color correction parameters is omitted in the present embodiments. For example, this tab enables designation of monochrome printing of color data.

FIG. 6B shows a state in which the paper feed tab 630 has been selected. The paper feed tab 630 includes a list box 631 for selecting a paper feed source and a list box 632 for selecting a paper type. The list box 631 enables the user to select a paper feed source loaded with sheets to be used in printing. The list box 631 includes "automatic" for automatically selecting a paper feed source. The list box 632 enables the user to select a paper type to be used in printing. The list box 632 includes "prioritize panel" for conforming to the paper type set in the main body of the image forming apparatus 100. In FIG. 6B, "automatic" for automatically selecting a paper feed source and "prioritize panel" are selected.

When the OK button 651 is pressed, the printer driver generates a print job on the basis of the print settings configured on this screen and a rendering command transmitted from the application, and starts transmitting the print job to the image forming apparatus 100. The cancel button 652 is used to discard the settings configured on this screen and to return to the application again.

FIGS. 7A-7C are schematic diagrams of data handled by the image forming apparatus 100 according to the embodiments.

The nonvolatile memory 203 stores the user setting information 700 that has been set by the user operating the console unit 101. The hard disk drive 104 stores a print job 720. The RAM 250 stores the print job information 750, the print page information 760, and media sensor detection result information 780 indicating paper types.

Although the programs in the RAM 250 may temporarily retain data that is temporarily used as work, such as a loop counter, a description thereof is complicated, and hence, is omitted. In some cases, the RAM 250 may be provided with a cache memory because the access speeds of the nonvolatile memory 203 and the hard disk drive 104 are lower than the access speed of the RAM 250. Therefore, the RAM 250 may store the same information as the nonvolatile memory 203 and the hard disk drive 104.

The details of the data handled by the image forming apparatus 100 will now be described in order.

First, information stored in the nonvolatile memory 203 will be described below.

The user setting information 700 includes the paper size setting information 701, the first paper type information 702, the default paper feed source information 703, the default paper size information 704, the default paper type information 705, the escape tray setting information 706, the tray priority setting information 707, and the media sensor detection level setting information 708. Pieces of information included in the user setting information 700 may be managed on an individual basis, or may be collectively managed, as will be described later. In the following description, the pieces of information included in the user setting information 700 are managed separately depending on whether they are unique settings that are unique to each paper feed source, or common settings that are shared in common with all paper feed sources. The unique settings include the paper size setting information 701 and the first paper type information 702. Table 1 shows an example of the unique settings.

TABLE 1

| | Paper Size Setting Information | First Paper Type Information |
|---|---|---|
| Manual Feed Tray | A4 | Plain Paper |
| Cassette 1 | A4 | Free |
| Cassette 2 | A4 | Thick Paper |
| Cassette 3 | A3 | Plain Paper |
| Cassette 4 | B5 | Free |

The paper size setting information 701 represents setting values indicating the paper sizes of sheets loaded in the paper feed sources, and these setting values are set by the user via the manual feed paper size setting screen 512 shown in FIG. 5A and paper size setting screens for the cassettes (not shown in FIGS. 5A and 5B).

The first paper type information 702 represents setting values indicating the types of sheets loaded in the paper feed sources, and these setting values are set by the user via the manual feed paper type setting screen 513 shown in FIG. 5A and paper type setting screens for the cassettes (not shown in FIGS. 5A and 5B).

The common settings include the default paper feed source information 703, the default paper size information 704, the default paper type information 705, the escape tray setting information 706, the tray priority setting information 707, and the media sensor detection level setting information 708. Table 2 shows an example of the common settings.

TABLE 2

| Setting Value | | Value |
|---|---|---|
| Default Paper Feed Source Information | | Cassette 1 |
| Default Paper Size Information | | A4 |
| Default Paper Type Information | | Plain Paper |
| Escape Tray Setting Information | | No |
| Tray Priority Setting Information | | No |
| Media Sensor Detection Level Setting Information | Manual Feed Tray | Full Detection |
| | Cassettes | Automatic Detection |

The default paper feed source information 703 indicates a default paper feed source set via the default paper feed source setting screen 531 shown in FIG. 5A. In Table 2, "cassette 1" is a paper feed source included in the image forming apparatus 100, and is set as the default paper feed source. The default paper size information 704 represents a default setting value of a paper size set via the default paper size setting screen 532 shown in FIG. 5A. In Table 2, the A4 size is set as a default paper size. The default paper type information 705 represents a default setting value of a paper type set via the default paper type setting screen 533 shown in FIG. 5A. In Table 2, plain paper is set as a default paper type. The escape tray setting information 706 represents a setting value for setting whether to use the manual feed tray in a recovery in the event of an error, and this setting value is set via the escape tray setting screen 541, shown in FIG. 5B. In Table 2, "no" is set. The tray priority setting information 707 represents a setting value for setting whether to prioritize selection of the manual feed tray during the automatic paper feed source selection, and this setting value is set via the tray priority setting screen 542, shown in FIG. 5B. In Table 2, "no" is set. The media sensor detection level setting information 708 represents setting values indicating the detection levels of the media sensor, and these setting values are set via the sensor detection level setting screen 550 and the manual feed tray detection level setting screen 551 shown in FIG. 5B. In Table 2, the detection level with respect to the manual feed tray is set to "full detection," and the detection level with respect to the cassettes is set to "automatic detection."

A description is now given of information stored in the hard disk drive 104.

Specifically, the print job 720 will be described. Upon receiving a request to execute a print job from the user, an application that runs on the information processing apparatus 150 notifies the printer driver of a rendering command. The printer driver generates PDL data on the basis of the rendering command, and transmits the PDL data to the image forming apparatus 100. The print job reception module 402 in the image forming apparatus 100 accordingly receives the PDL data, and stores the PDL data as the print job 720 to the hard disk drive 104. The PDL data generated by the printer driver may be in any data format as long as the image forming apparatus 100 is compatible with the data format. When the image forming apparatus 100 does not include the hard disk drive 104, this print job data can be stored to the nonvolatile memory 203 or the RAM 250. Thereafter, the image forming apparatus 100 interprets the print job 720 and executes print processing.

In the present embodiments, data shown in FIGS. 7A to 7C is used as the print job. The print job 720 describes commands to be executed in order, thereby presenting the content to be rendered. A job start command 721 gives notice of the start of the print job. Once the print job analyzer 404 has interpreted the job start command 721, the print job analyzer 404 stores the content of the default paper feed source information 703 to (job) output paper feed source information 753 in the RAM 250. The print job analyzer 404 also stores the content of the default paper size information 704 and the content of the default paper type information 705 to (job) output paper size information 751 and to (job) output paper type information 752 in the RAM 250, respectively.

A paper feed source designation command 722 designates a paper feed source to be used in the present print job on the basis of, for example, the content that has been selected by the user from the list box 631 for selecting a paper feed source shown in FIG. 6B. The designated setting is stored also to the (job) output paper feed source information 753 in the RAM 250. A paper type designation command 723 designates a paper type to be used in the present print job on the basis of, for example, the content that has been selected by the user from the list box 632 for selecting a paper type shown in FIG. 6B. The designated setting is stored also to the (job) output paper type information 752 in the RAM 250.

A page start command 724 indicates the start of a command group of a present print page. The print job analyzer 404 interprets the page start command 724, and then stores the (job) output paper size information 751 and the (job) output paper type information 752 to output paper size information 761 and to output paper type information 762 in the print page information 760, respectively. The print job analyzer 404 also stores the content of the (job) output paper feed source information 753 to output paper feed source information 763 in the print page information 760.

A paper size designation command 725 designates a paper size to be used for the present page. The print job analyzer 404 analyzes the paper size designation command 725, and then rewrites the output paper size information 761 in the print page information 760 on the basis of the content of the analyzed command. Rendering commands 726 and 728 indicate the content to be rendered for the present page. The rendering commands specifically include a command for rendering a straight line and a command for rendering characters. In some cases, several hundred or several thousand rendering commands compose one page. The print job analyzer 404 analyzes the rendering commands 726 and 728, and then generates a DisplayList 764.

A page end command 729 indicates the end of the command group of the present page. The print job analyzer 404 analyzes the page end command 729, and then notifies the sub job controller 431 of information in the print page information 760. In response, the sub job controller 431 executes print processing in accordance with the content of the print page information 760.

When the print job 720 includes a plurality of pages, processing is repeated again in accordance with a group of a sequence of commands from a page start command 734 to a page end command 739. A job end command 740 indicates the end of the present print job. The job end command 740 establishes, for example, the number of pages included in the present print job.

Although the above description relates to an example in which a paper feed source and a paper type are designated before the page start command 724, the paper feed source and the paper type may be designated after the page start command 724. It is preferable that the above description also applies to a case in which the rendering commands, the paper type designation command, the paper size designation command, and the like, exist in a mixed manner.

As an example, in the present embodiments, PDL data with which the content to be rendered is presented through sequential interpretation of rendering commands. For example, a blue rectangle is rendered by combining a rendering command that designates blue as the color of a pen, a rendering command that designates a rectangular shape, and a rendering command for filling the rectangular shape. Alternatively, PDL data presenting rendering objects including rendering parameters may be used. In this case, one rendering object is given an attribute that defines filling of a rectangle with blue.

The print job information 750 holds print settings of the present print job. The print job information 750 includes the (job) output paper size information 751, the (job) output paper type information 752, and the (job) output paper feed source information 753. The print job information 750 is overwritten (initialized) by the print job analyzer 404 on the basis of information of the paper size, the paper type, and the paper feed source stored in the user setting information 700 when the print job analyzer 404 has interpreted the job start command 721. The print job information 750 is also updated by the print job analyzer 404 in accordance with the paper feed source designation command, the paper type designation command, the paper size designation command, and the like, when these commands are interpreted before interpreting the page start command 724 and after interpreting the page end command 729. Table 3 shows an example of the print job information 750.

TABLE 3

| Setting Value | Value |
|---|---|
| (Job) Output Paper Feed Source Information | Cassette 2 |
| (Job) Output Paper Size Information | A4 |
| (Job) Output Paper Type Information | Plain Paper |

The (job) output paper size information 751, the (job) output paper type information 752, and the (job) paper feed source information 753 store the paper size, the paper type, and the paper feed source that have been designated by the print job, respectively. In the example of Table 3, "cassette 2" is set as the paper feed source, "A4" is set as the paper size, and "plain paper" is set as the paper type. Although not shown in this table, "prioritize panel" that designates the paper size, the paper type, and the paper feed source, set by the user in the image forming apparatus 100, can be set. Alternatively, "free" can be designated.

The print page information 760 holds print settings of the present page, and includes the output paper size information 761, the output paper type information 762, the output paper feed source information 763, and the DisplayList 764. Values of the print page information 760 are overwritten (initialized) by the print job analyzer 404 on the basis of the setting values of the print job information 750 when the page start command is analyzed by the print job analyzer 404. The values of the print page information 760 are also updated by the print job analyzer 404 upon reception of a change in the settings via the paper feed source designation command, the paper type designation command, the paper size designation command, and the like, in a period that follows the interpretation of the page start command and precedes the interpretation of the page end command. Table 4 shows an example of the print page information 760.

TABLE 4

| Setting Value | Value |
|---|---|
| (Job) Output Paper Feed Source Information | Cassette 2 |
| (Job) Output Paper Size Information | A4 |
| (Job) Output Paper Type Information | Plain Paper |
| DisplayList | (Binary Data) |

In the example of Table 4, "cassette 2," "A4," and "plain paper" are set as the output paper feed source information 763, the output paper size information 761, and the output paper type information 762, respectively. "Prioritize panel" and "free" can be set as well. The DisplayList 764 is binary data indicating the result of analysis of the group of rendering commands included in the present page. The DisplayList 764 is presented as, for example, variable-length data using a list structure, and the like.

Image data for printing 770 is generated to enable the image processor 223 to interpret the content of the DisplayList 764 and to enable the printer engine 105 to perform printing. For example, the image data for printing 770 is obtained by compressing a halftone image corresponding to one page made up of four color components, i.e., a C component, an M component, a Y component, and a K component. Alternatively, one page may be divided into a plurality of bands or rectangular blocks, and the plurality of bands or rectangular blocks may be compressed and held as the image data for printing. Lossless compression or lossy compression may be used as a compression method. Although the image data for printing 770 is held in the RAM 250 in the present description, it may be stored in the hard disk drive 104. The image data for printing 770 can be realized using a wide variety of methods, and the present invention is applicable using any of such methods.

The media sensor detection result information 780 is data indicating the results of detection of paper types by the media sensor 314. The media sensor detection result information 780 includes a sensor detection counter 781, a provisional detection result 782, and second paper type information 783. Immediately after the image forming apparatus 100 is activated, the device controller 434 initializes the content of the sensor detection counter 781 to "0," and initializes the content of the second paper type information 783 to "undetected." When one of the doors of the cassettes 302-1 to 302-4 is opened, the device controller 434 sets information corresponding to the cassette with the opened door in the sensor detection counter 781 to "0". The device controller 434 also sets information corresponding to that cassette in the second paper type information 783 to "undetected." It is preferable to execute such initialization processing at other timings, such as when a supply of electrical power to the printer engine 105 is stopped for the purpose of conserving the consumption of electrical c power. Table 5 shows an example of the media sensor detection result information 780.

TABLE 5

| | Sensor Detection | Provisional Detection Result | | | | | Second Paper Type |
|---|---|---|---|---|---|---|---|
| | Counter | 0 | 1 | 2 | 3 | 4 | Information |
| Manual Feed Tray | 0 | None | None | None | None | None | Undetected |
| Cassette 1 | 3 | Plain Paper | Plain Paper | Thick Paper | None | None | Plain Paper |
| Cassette 2 | 0 | None | None | None | None | None | Undetected |
| Cassette 3 | 0 | None | None | None | None | None | Undetected |
| Cassette 4 | 16 | Thin Paper | Plain Paper | Thin Paper | Thin Paper | Thin Paper | Thin Paper |

The sensor detection counter 781 indicates the number of sheets that have been detected by each of the remaining paper amount sensors 321-1 to 321-4 in the cassettes. The provisional detection result 782 shows paper types that have been detected by the media sensor 314 in correspondence with the number of detected sheets with respect to each paper feed source. The example of Table 5 indicates that, with respect to the cassette 1, the first and second sheets have been detected as "plain paper," and the third sheet has been detected as "thick paper." The example also indicates that, with respect to the cassette 4, the sensor detection counter 781 has detected sixteen sheets, and the first five sheets have been detected by the media sensor 314 as thin paper, except for one sheet that has been detected as plain paper. The detection results of up to five sheets (a threshold of "5") are stored with respect to each paper feed source.

The second paper type information 783 indicates paper types detected by the media sensor 314. When the value of the sensor detection counter 781 is smaller than the threshold (5) (smaller than a predetermined number), the paper type detected from the first sheet is used as the second paper type information of the corresponding paper feed source. Therefore, in the example of Table 5, the paper type of "cassette 1" is set to "plain paper" detected from the first sheet. On the other hand, when the value of the sensor detection counter 781 is equal to or larger than the threshold (5) (equal to or larger than the predetermined number), the paper type that appears most frequently among the paper types that have been detected up until that point is used as the second paper type information of the corresponding paper feed source. Therefore, in the present example, the second paper type information 783 of the cassette 4 is "thin paper." These pieces of information may be stored in the RAM 250, a dedicated RAM, or a dedicated nonvolatile memory.

The above description has been given under the assumption that the image forming apparatus 100 has one piece of print page information 760. Alternatively, a plurality of pieces of print page information 760 may be provided under the assumption that a time period for which the print job analyzer 404 analyzes the print job 720 corresponding to one page may be shorter than a time period for which the printer engine 105 prints a sheet, or sheets, of paper corresponding to one page. Specifically, when the print job analyzer 404 has analyzed the page start command, print page information corresponding to a present page is generated. Then, when the device controller 434 detects the timing at which the printer engine 105 completes printing of the present page, the main job controller 401 is notified of the completion via the sub job controller 431. In response, the main job controller 401 discards the print page information corresponding to the present page. In this way, while the printer engine 105 is executing print processing for the first page included in the print job 720, the print job analyzer 404 can analyze commands for the second and third pages in the print job 720.

[First Embodiment]

Figure 11A:
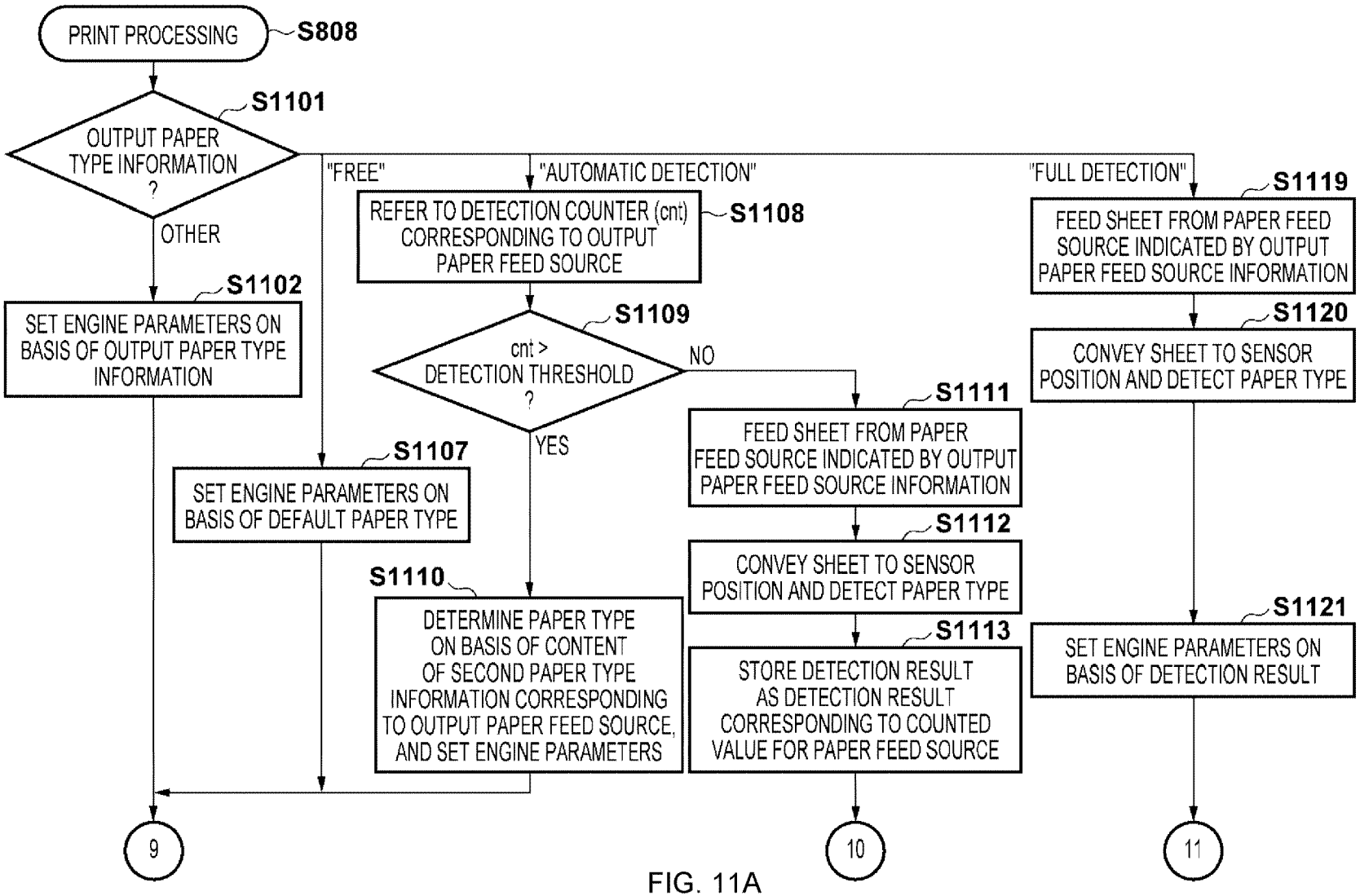
FIG. 11A is a flowchart for describing print processing in step S808 of FIG. 8B.
Figure 11B:
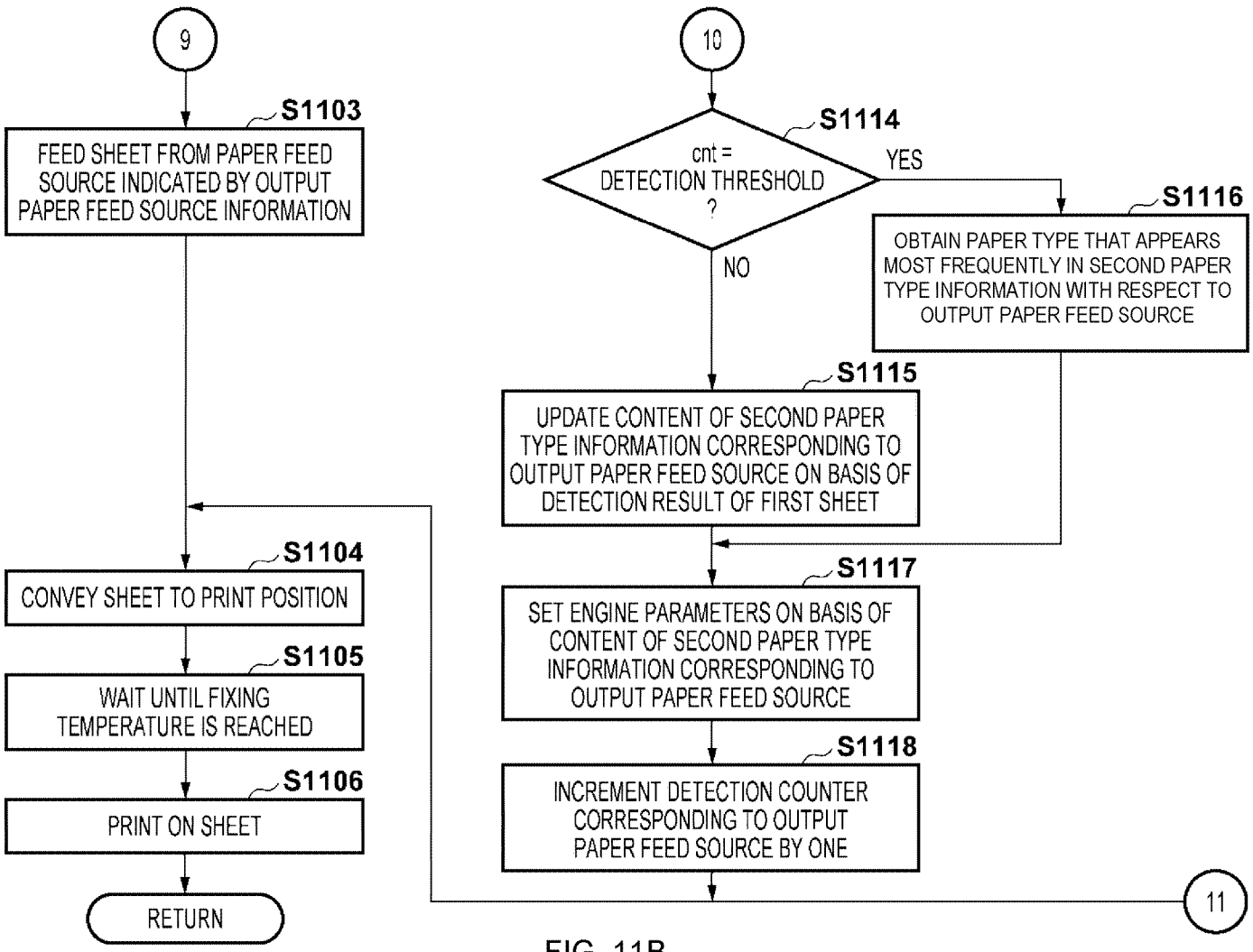
FIG. 11B is a flowchart for describing print processing in step S808 of FIG. 8B.
Figure 12:
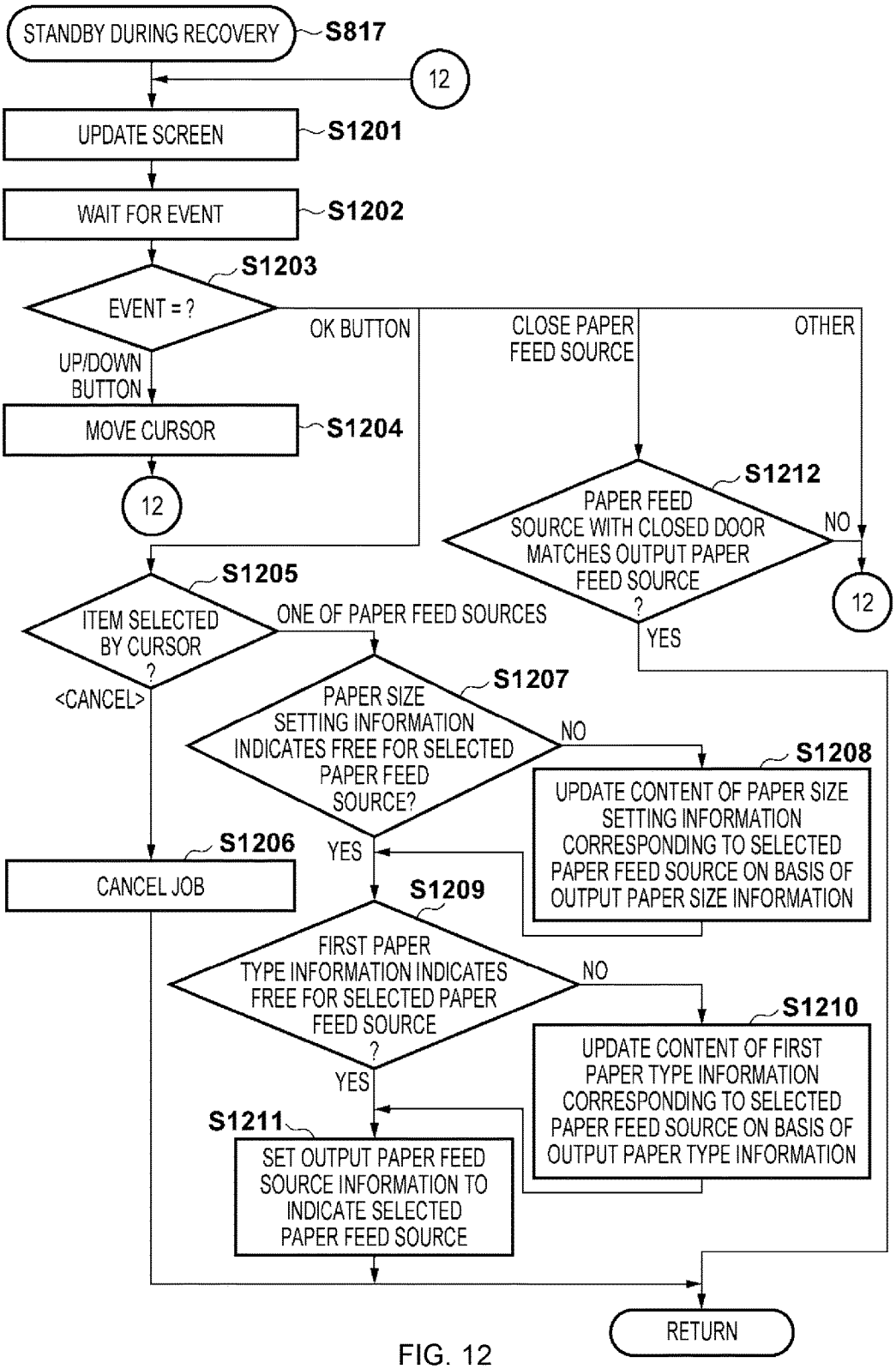
FIG. 12 is a flowchart for describing standby processing during a recovery in step S817 of FIG. 8B.
Figure 13A:
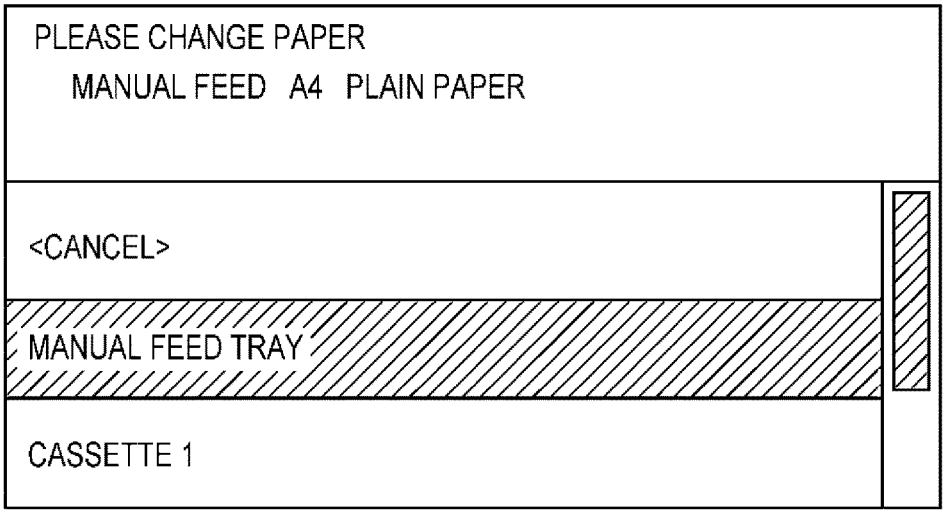
FIG. 13A depicts a view illustrating an example of an error screen displayed by the image forming apparatus according to the first embodiment while on standby during the recovery.
Figure 13B:
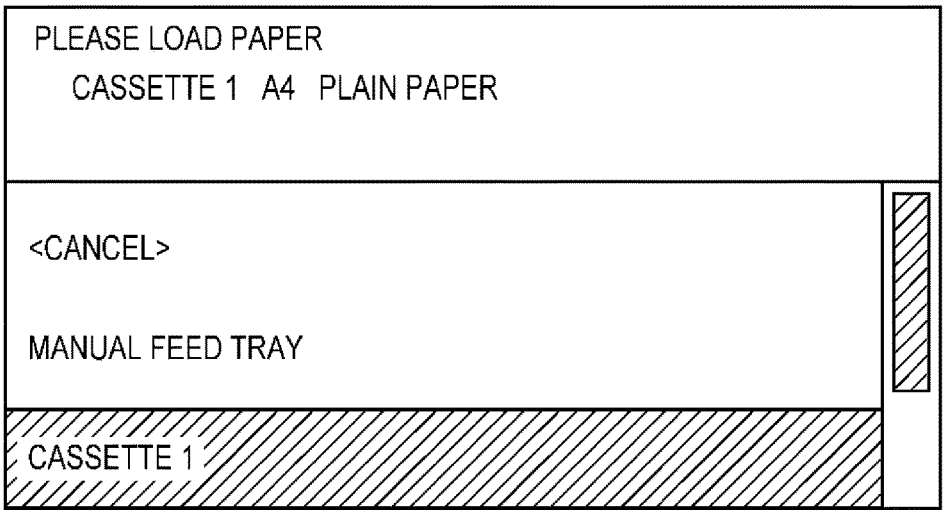
FIG. 13B depicts a view illustrating an example of an error screen displayed by the image forming apparatus according to the first embodiment while on standby during the recovery.

The following describes control processing of the control unit 102 in the image forming apparatus 100 according to a first embodiment of the present invention, with reference to flowcharts of FIGS. 8A to 12 and exemplary screens of the display unit 124 in the console unit 101 shown in FIGS. 13A and 13B.

Figure 8A:
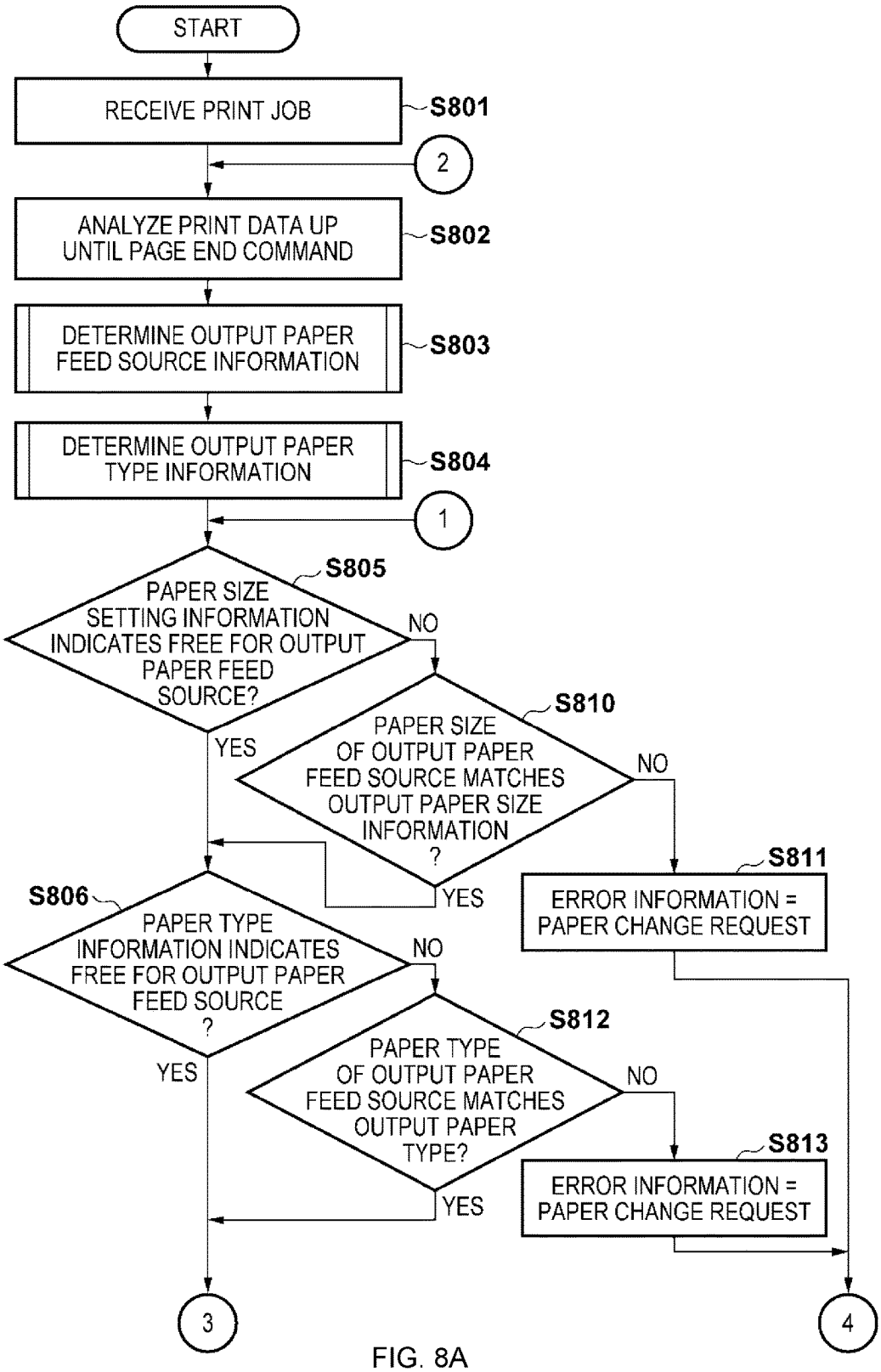
FIG. 8A is a flowchart for describing processing of a control unit in the image forming apparatus according to a first embodiment, from the reception of a print job to printing.
Figure 8B:
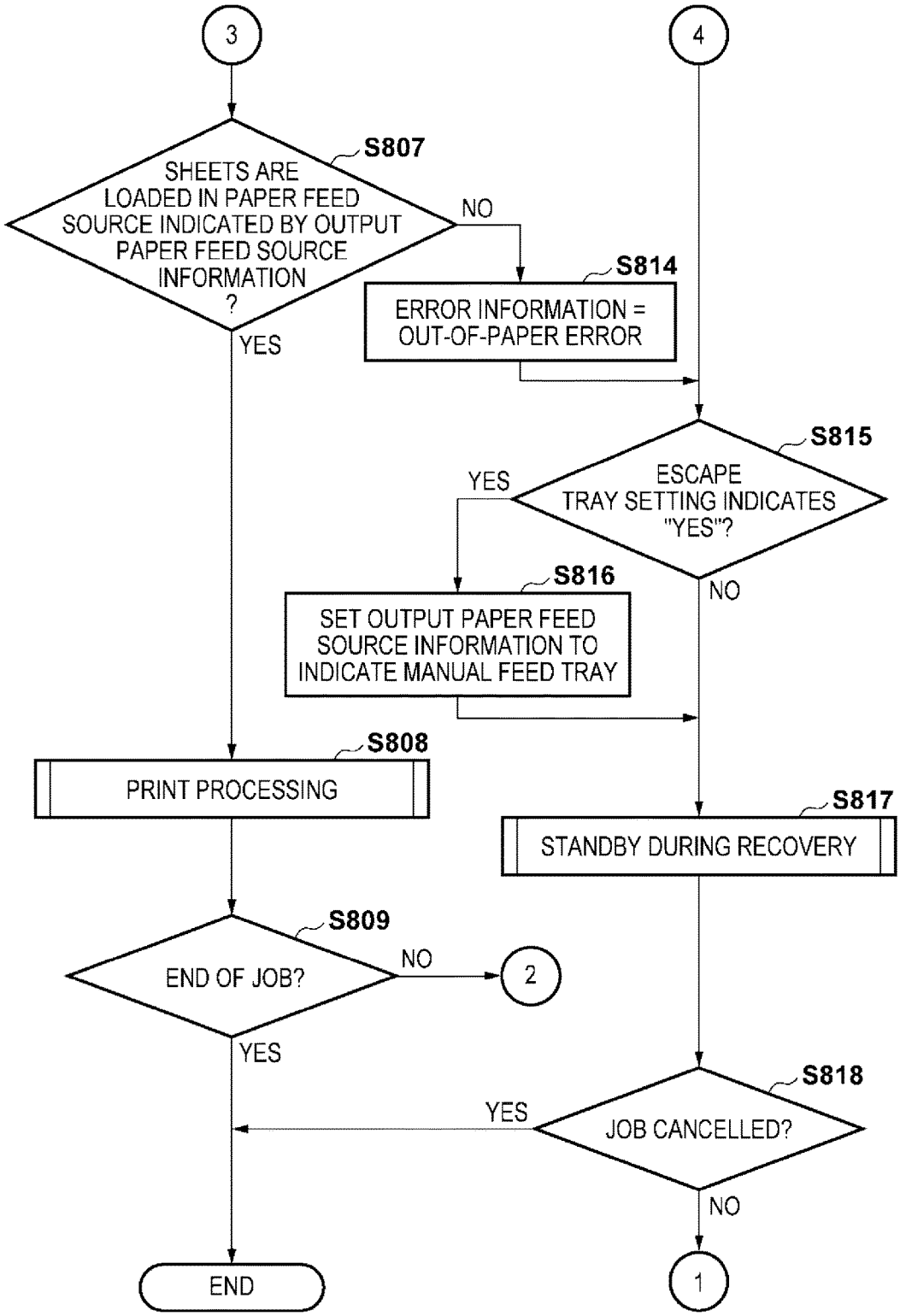
FIG. 8B is a flowchart for describing processing of a control unit in the image forming apparatus according to a first embodiment, from the reception of a print job to printing.

FIGS. 8A and 8B are flowcharts for describing processing of the control unit 102 in the image forming apparatus 100 according to the first embodiment, from the reception of a print job to printing. A program that executes the processing is installed in the hard disk drive 104. Upon executing the processing, the program is deployed to the RAM 250 and executed by the CPU 201 and the sub CPU 221. The flowchart of the processing will now be described on the basis of the structures of the software modules shown in FIG. 4.

First, in step S801, the print job reception module 402 receives a print job transmitted from the information processing apparatus 150 via a network, and stores the print job to the hard disk drive 104. In the next step S802, the print job analyzer 404 analyzes the stored print job up until a page end command, and then updates the print job information 750 and the print page information 760 on the basis of the paper size, the paper type, the paper feed source, and the like, designated by the print job. In the next step S803, the main job controller 401 determines paper feed source information for setting a paper feed source to be used in printing on the basis of the print page information 760. The details of this process will be described later with reference to flowcharts of FIGS. 9A and 9B.

In the next step S804, the main job controller 401 determines a paper type to be used in printing on the basis of the print page information 760. The details of this process will be described later with reference to flowcharts of FIGS. 10A and 10B.

In the next step S805, the main job controller 401 determines whether or not the paper size setting information 701 indicates "free" for a paper feed source indicated by the output paper feed source information. For example, in the state of Table 1, when the output paper feed source information indicates "cassette 3," the paper size setting information indicates "A3" therefor. If it is determined in step S805 that the paper size setting information does not indicate "free," the processing proceeds to step S810 in which the main job controller 401 determines whether or not the content of the paper size setting information corresponding to the paper feed source indicated by the output paper feed source information matches the output paper size information 751 designated by the print job. If it is determined that they do not match in step S810, the processing proceeds to step S811 in which the main job controller 401 displays error information to which a paper change request has been added, and then the processing proceeds to step S815.

On the other hand, if the paper size setting information indicates "free" in step S805, or if the content of the paper size setting information corresponding to the paper feed source indicated by the output paper feed source information matches the output paper size information in step S810, the processing proceeds to step S806 in which the main job controller 401 determines whether or not the first paper type information 702 indicates "free" for the paper feed source indicated by the output paper feed source information 763. For example, in the state of Table 1, when the paper feed source information to be used in printing indicates "cassette 3," the first paper type information indicates "plain paper" therefor. If the paper type information does not indicate "free" in step S806, the processing proceeds to step S812, in which the main job controller 401 determines whether or not the corresponding content of the paper type information matches the output paper type information. If it is determined that they do not match in step S812, the processing proceeds to step S813, in which the main job controller 401 displays error information that has been assigned a paper change request error, and then the processing proceeds to step S815.

On the other hand, if the paper type information is "free" in step S806, or if the corresponding content of the paper type information matches the output paper type information in step S812, the processing proceeds to step S807. This occurs when the paper size and the paper type indicate "free," or when the paper size and the paper type of the sheets set in the output paper feed source match the paper size and the paper type designated by the print job. In step S807, the main job controller 401 obtains, from the device controller 434, information indicating whether sheets are loaded in the paper feed source indicated by the output paper feed source information to be used in printing, and determines whether or not sheets are loaded in the indicated paper feed source. If it is determined that sheets are not loaded in the indicated paper feed source, the processing proceeds to step S814, in which the main job controller 401 displays error information that has been assigned an out-of-paper error, and then the processing proceeds to step S815.

If it is determined in step S807 that sheets are loaded in the paper feed source indicated by the output paper feed source information, the processing proceeds to step S808, in which the sub job controller 431 executes print processing for a present page. The details of the print processing will be described later with reference to flowcharts of FIGS. 11A and 11B. In the next step S809, the print job analyzer 404 determines whether or not the present print job has been analyzed up until a job end command, ends the print processing for the job if the job has been analyzed up until the job end command, and proceeds to step S802 if the job has not been analyzed up until the job end command.

In step S815, the main job controller 401 determines whether or not the escape tray setting information 706 is set to "yes." If the escape tray setting information 706 is not set to "yes," the processing proceeds to step S817, and if it is set to "yes," the processing proceeds to step S816, in which the output paper feed source information is changed to indicate the manual feed tray, and then the processing proceeds to step S817. In the next step S817, the main job controller 401 enters a standby state while the user is executing recovery processing. The details of the recovery processing will be described later with reference to a flowchart of FIG. 12.

When the recovery processing of step S817 is ended, the processing proceeds to step S818, in which the main job controller 401 determines whether or not cancellation of the job has been selected. If the job has been cancelled, the print processing based on the job is ended. On the other hand, if the job has not been cancelled in step S818, the processing proceeds to step S805 to determine whether or not printing can be performed again. In the above-described manner, the print job is executed when the sheets designated by the print job are loaded in the paper feed source to be used in printing, or when printing that uses another paper feed source is designated.

Figure 9A:
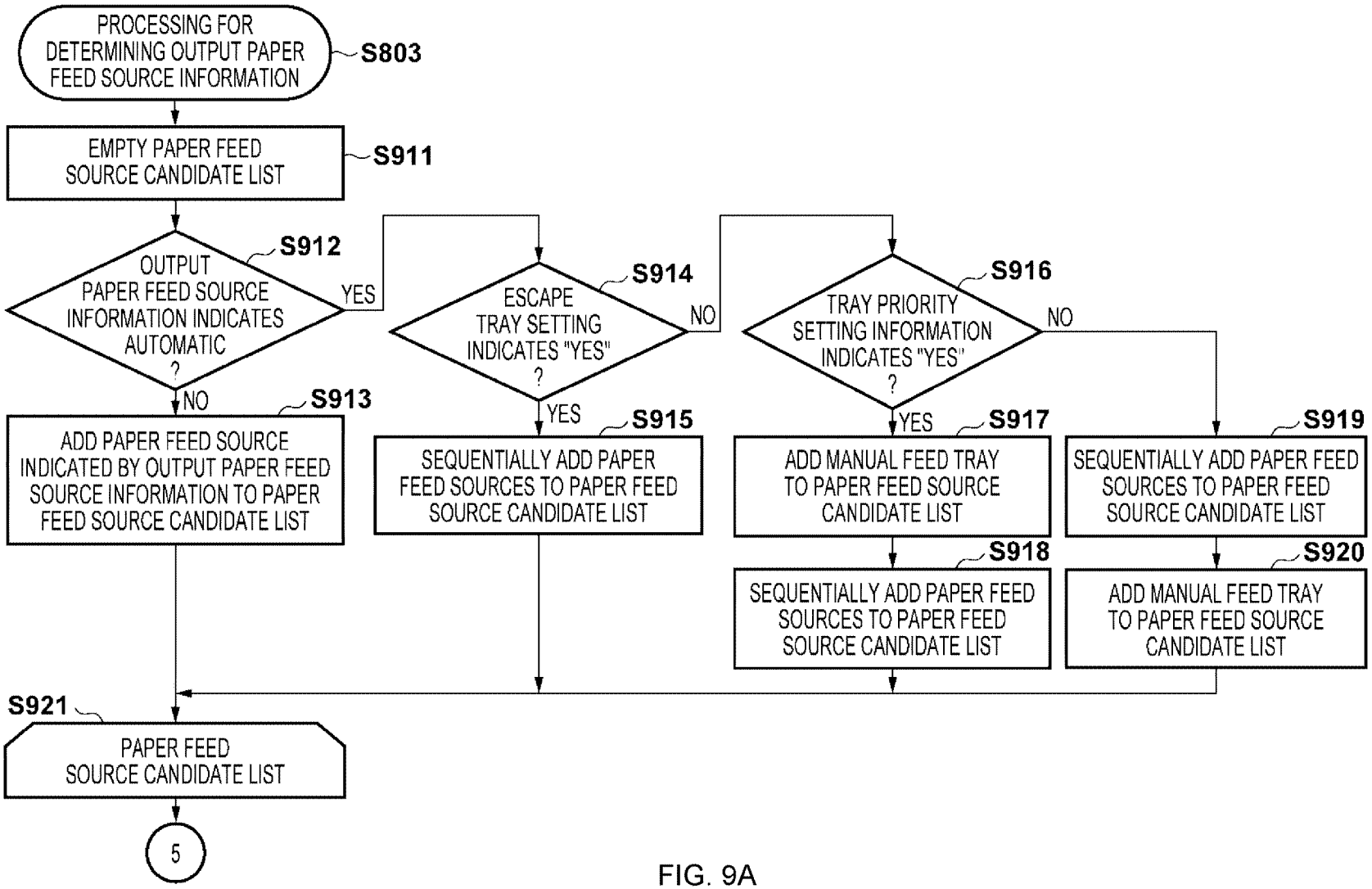
FIG. 9A is a flowchart for describing processing for determining output paper feed source information in step S803 of FIG. 8A.
Figure 9B:
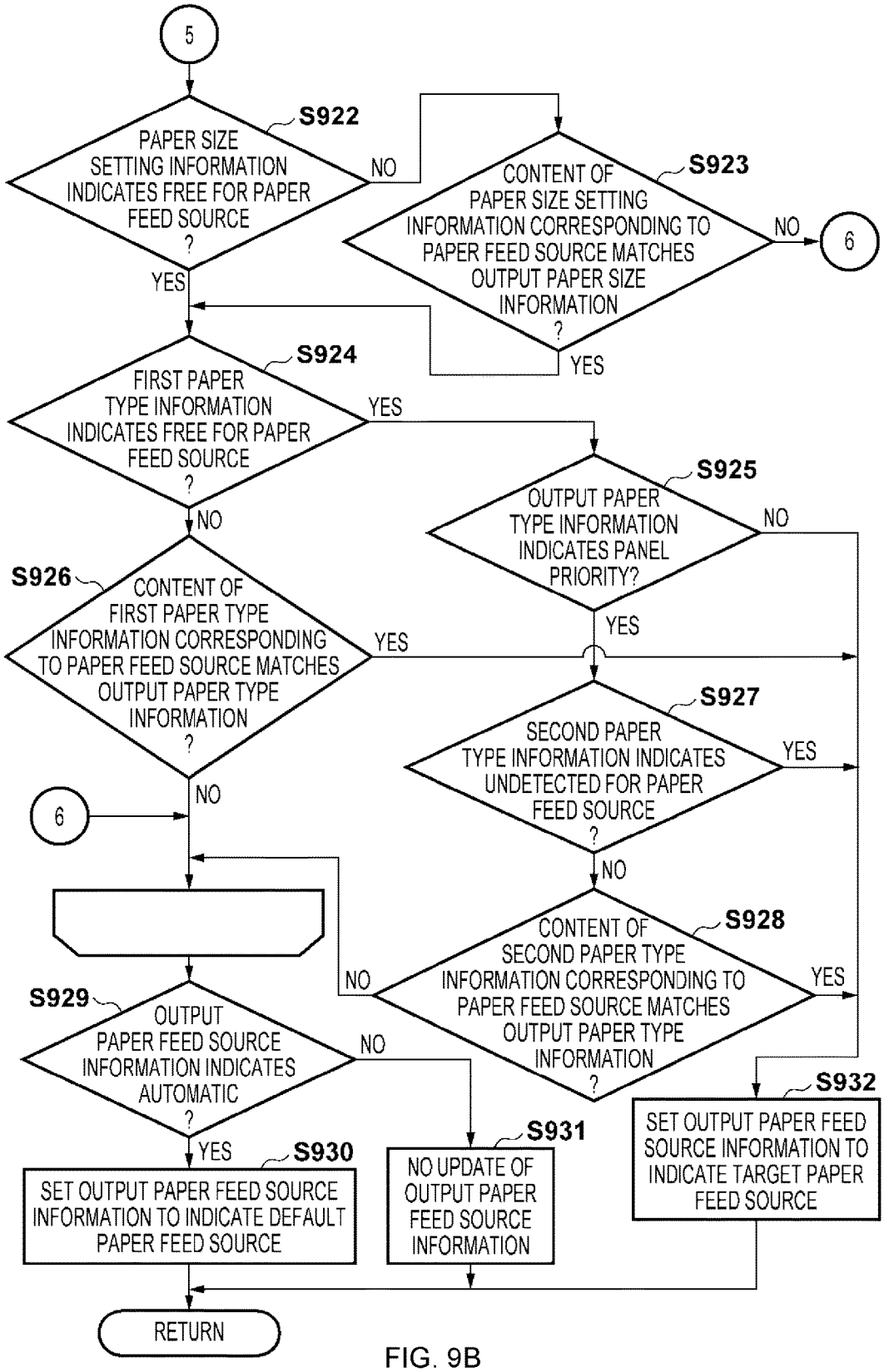
FIG. 9B is a flowchart for describing processing for determining output paper feed source information in step S803 of FIG. 8A.

FIGS. 9A and 9B are flowcharts for describing processing for determining the output paper feed source information in step S803 of FIG. 8A. Through the processing, the main job controller 401 determines a paper feed source, from which sheets are to be fed in printing, on the basis of the output paper feed source information 763 in the print page information 760, and then updates the output paper feed source information 763 on the basis of the result of the determination.

First, in step S911, the main job controller 401 clears a paper feed source candidate list. In the next step S912, the main job controller 401 determines whether or not the output paper feed source information 763 indicates "automatic." If the output paper feed source information indicates "automatic," the processing proceeds to step S914. If not, the processing proceeds to step S913, in which the main job controller 401 adds the paper feed source indicated by the output paper feed source information 763 to the paper feed source candidate list, and then the processing proceeds to step S921. For example, when the output paper feed source information 763 indicates "cassette 1," the paper feed source candidate list shows "cassette 1."

If the output paper feed source information 763 indicates "automatic," the processing proceeds to step S914, in which the main job controller 401 determines whether or not the escape tray setting information 706 indicates "yes." If the escape tray setting information indicates "yes," the processing proceeds to step S915, in which the main job controller 401 sequentially adds paper feed sources to the paper feed source candidate list, and then the processing proceeds to step S921. As a result, the paper feed source candidate list shows "cassette 1," "cassette 2," "cassette 3," and "cassette 4." On the other hand, if the escape tray setting information 706 does not indicate "yes," the processing proceeds to step S916, in which the main job controller 401 determines whether or not the tray priority setting information 707 indicates "yes." If the tray priority setting information indicates "yes," the processing proceeds to step S917, in which the main job controller 401 adds the manual feed tray to the paper feed source candidate list. Thereafter, the processing proceeds to step S918, in which the main job controller 401 sequentially adds paper feed sources to the paper feed source candidate list, similarly to step S915, and then the processing proceeds to step S921. As a result, the paper feed source candidate list shows "manual feed tray," "cassette 1," "cassette 2," "cassette 3," and "cassette 4."

On the other hand, if the tray priority setting information 707 indicates "no" in step S916, the processing proceeds to step S919, in which the main job controller 401 sequentially adds paper feed sources to the paper feed source candidate list, similarly to step S915. In the next step S920, the main job controller 401 adds the manual feed tray in the paper feed source candidate list, and then the processing proceeds to step S921. As a result, the paper feed source candidate list shows "cassette 1," "cassette 2," "cassette 3," "cassette 4," and "manual feed tray."

Thereafter, in step S921 to step S928, the main job controller 401 repeats the following processes in sequence with respect to each paper feed source included in the paper feed source candidate list.

First, in step S922, the main job controller 401 determines whether or not the paper size setting information 701 indicates "free" for the paper feed source indicated by the output paper feed source information. If the paper size setting information 701 does not indicate "free," the processing proceeds to step S923, in which the main job controller 401 determines whether or not the corresponding content of the paper size setting information matches the output paper size information 761 indicated by the print job. If it is determined that they do not match, the next paper feed source candidate is obtained from the paper feed source candidate list, and the foregoing processes are executed. On the other hand, if the paper size setting information indicates "free" in step S922, or if it is determined in step S923 that the corresponding content of the paper size setting information matches the output paper size information 761, it means that a condition related to the paper size is satisfied with respect to the indicated paper feed source, and thus, the processing proceeds to step S924.

In step S924, the main job controller 401 determines whether or not the first paper type information 702 indicates "free" for the paper feed source indicated by the output paper feed source information 763. If the first paper type information does not indicate "free," the processing proceeds to step S926, in which the main job controller 401 determines whether or not the content of the first paper type information 702 corresponding to the indicated paper feed source matches the output paper type information 762 designated by the print job. If they match in step S926, the processing proceeds to step S932, and if not, the main job controller 401 obtains the next paper feed source candidate from the paper feed source candidate list, and executes the foregoing processes. In step S932, the main job controller 401 updates the output paper feed source information 763 on the basis of the current (target) paper feed source candidate that satisfies the foregoing conditions, and then, the processing is ended. As a result, the paper feed source loaded with sheets that satisfy the conditions of the print job is specified.

On the other hand, if the paper type information indicates "free" in step S924, the processing proceeds to step S925, in which the main job controller 401 determines whether or not the output paper type information 762 indicates "panel priority." If the output paper type information does not indicate "panel priority," the processing proceeds to step S932, in which the main job controller 401 updates the output paper feed source information 763 on the basis of the target paper feed source, and then, the processing is ended. On the other hand, if the output paper type information 762 indicates "panel priority," the processing proceeds to step S927, in which the main job controller 401 determines whether or not the second paper type information 783 indicates "undetected" for the paper feed source indicated by the output paper feed source information 763. If the second paper type information indicates "undetected," the processing proceeds to step S932 in which the main job controller 401 updates the output paper feed source information 763 on the basis of the indicated paper feed source, and then, the processing is ended. On the other hand, if the second paper type information does not indicate "undetected" in step S927, the processing proceeds to step S928, in which the main job controller 401 determines whether or not the content of the second paper type information 783 corresponding to the paper feed source indicated by the output paper feed source information 763 matches the output paper type information 762 designated by the print job. If it is determined that they match, the processing proceeds to step S932, and if not, the main job controller 401 obtains the next paper feed source candidate from the paper feed source candidate list, and executes the foregoing processes.

Step S929 is executed when a paper feed source that conforms to the print job has not been found after the main job controller 401 has subjected all of the paper feed sources included in the paper feed source candidate list to the determination of whether they conform to the print job. In step S929, the main job controller 401 determines whether or not the output paper feed source information 763 indicates "automatic." If it is determined that the output paper feed source information indicates "automatic," the processing proceeds to step S930, in which the main job controller 401 updates the output paper feed source information 763 on the basis of the default paper feed source information 703, and then, the processing is ended. On the other hand, if the output paper feed source information 763 does not indicate "automatic," the main job controller 401 does not update the output paper feed source information 763 in the next step S931, and then, the processing is ended.

Through the above-described processing, the paper feed source loaded with sheets that satisfy the conditions of the print job is determined.

Figure 10A:
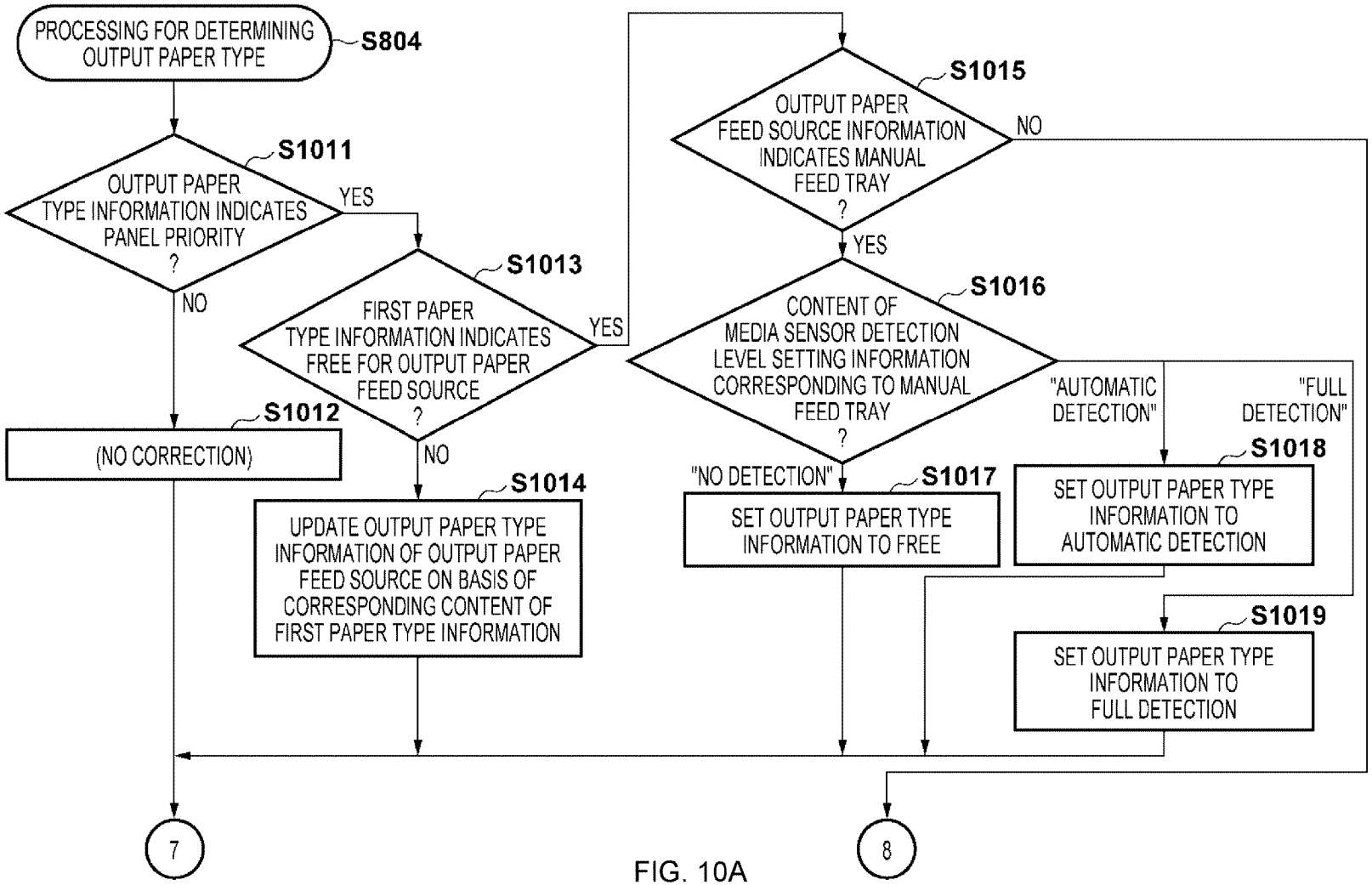
FIG. 10A is a flowchart for describing processing for determining output paper type information in step S804 of FIG. 8A.
Figure 10B:
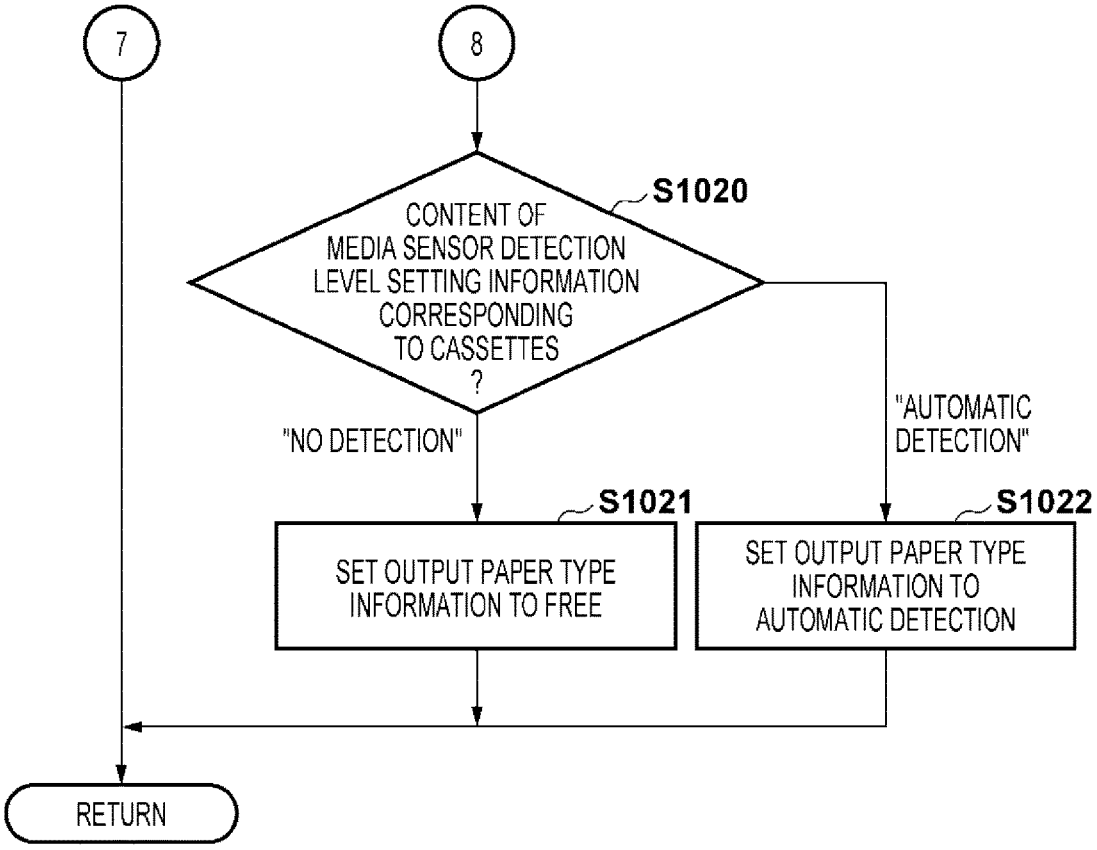
FIG. 10B is a flowchart for describing processing for determining output paper type information in step S804 of FIG. 8A.

FIGS. 10A and 10B are flowcharts for describing processing for determining the output paper type information in step S804 of FIG. 8A.

In this processing, the setting is left unchanged if the output paper type information 762, determining the paper type to be designated to the printer engine 105, does not indicate "panel priority." If the output paper type information 762 indicates "panel priority," the content of the first paper type information corresponding to the paper feed source indicated by the output paper feed source information 763, or one of "free," "automatic detection," and "full detection," is determined as the output paper type information 762.

First, in step S1011, the main job controller 401 determines whether or not the output paper type information 762 indicates "panel priority." If the output paper type information 762 does not indicate "panel priority," that is to say, if the output paper type information 762 designates one of the paper types, the processing proceeds to step S1012, in which the main job controller 401 does not execute any process, and then, the processing is ended.

On the other hand, if it is determined in step S1011 that the output paper type information indicates "panel priority," the processing proceeds to step S1013, in which the main job controller 401 determines whether or not the first paper type information 702 indicates "free" for the paper feed source indicated by the output paper feed source information 763. If the first paper type information 702 does not indicate "free," the processing proceeds to step S1014, in which the main job controller 401 updates the content of the output paper type information 762 on the basis of the content of the first paper type information 702 corresponding to the paper feed source indicated by the output paper feed source information 763, and then, the processing is ended.

On the other hand, if it is determined in step S1013 that the first paper type information 702 indicates "free" for the paper feed source indicated by the output paper feed source information 763, the processing proceeds to step S1015, in which the main job controller 401 determines whether or not the output paper feed source information 763 indicates "manual feed tray." If the output paper feed source information indicates "manual feed tray," the processing proceeds to step S1016, and the main job controller 401 proceeds to different processes on the basis of the content of the media sensor detection level setting information 708 corresponding to the manual feed tray. If the media sensor detection level setting information 708 indicates "no detection" in step S1016, the processing proceeds to step S1017, in which the main job controller 401 sets the output paper type information 762 to "free," and then, the processing is ended. If the media sensor detection level setting information 708 indicates "automatic detection" in step S1016, the processing proceeds to step S1018, in which the main job controller 401 sets the output paper type information 762 to "automatic detection," and then, the processing is ended. If the media sensor detection level setting information 708 indicates "full detection" in step S1016, the processing proceeds to step S1019, in which the main job controller 401 sets the output paper type information 762 to "full detection," and then, the processing is ended.

If the output paper feed source information 763 does not indicate "manual feed tray" (that is to say, one of the cassettes is selected) in step S1015, the processing proceeds to step S1020, and then to different processes on the basis of the content of the media sensor detection level setting information 708 corresponding to the cassettes. If the main job controller 401 determines in step S1020 that the media sensor detection level setting information 708 indicates "no detection" for the cassettes, the processing proceeds to step S1021, in which the main job controller 401 sets the output paper type information 762 to "free," and then, the processing is ended. On the other hand, if the media sensor detection level setting information 708 indicates "automatic detection" in step S1020, the processing proceeds to step S1022, in which the main job controller 401 sets the output paper type information 762 to "automatic detection," and then, the processing is ended.

FIGS. 11A and 11B are flowcharts for describing the print processing in step S808 of FIG. 8B. The print processing is executed under control by the sub job controller 431.

In the print processing, engine parameters including a fixing temperature and a paper conveyance speed are set in the printer engine 105 on the basis of the output sheet paper type information 762 and the results of detection by the media sensor, and the image data for printing 770 is printed on a sheet.

Table 6 shows examples of engine parameters that are set with respect to paper types. For example, when the output paper type information 762 indicates "thin paper," the sub job controller 431 notifies the printer engine 105 of "normal speed" as the conveyance speed, and "low" as the fixing temperature. This can suppress a sheet of thin paper from warping (curling) during printing. When the output paper type information 762 indicates "thick paper," the sub job controller 431 notifies the printer engine 105 of "½ speed" as the conveyance speed, and "high" as the fixing temperature. This can suppress poor fixing of toner to a sheet of thick paper during printing.

TABLE 6

| | Conveyance Speed | Fixing Temperature |
|---|---|---|
| Thin Paper | Normal Speed | Low |
| Plain Paper | Normal Speed | Normal |
| Thick Paper | ½ Speed | High |
| Glossy Paper | ⅓ Speed | High |

First, in step S1101, the sub job controller 431 determines the paper type indicated by the output paper type information 762, and the processing diverges on the basis of the paper type. If the sub job controller 431 determines in step S1101 that the output paper type information 762 indicates a specific paper type (that is to say, if it does not indicate "free," "automatic detection" or "full detection"), the processing proceeds to step S1102. The sub job controller 431 notifies the printer engine 105 of engine parameters based on the output paper type information 762 via the device controller 434, and then, the processing proceeds to step S1103.

If the sub job controller 431 determines in step S1101 that the output paper type information 762 indicates "free," the processing proceeds to step S1107. The sub job controller 431 notifies the printer engine 105 of engine parameters based on the paper type indicated by the default paper type information 705 via the device controller 434, and then, the processing proceeds to step S1103.

If it is determined in step S1101 that the output paper type information 762 indicates "automatic detection," the processing proceeds to step S1108, in which the sub job controller 431 refers to a detection counter (cnt) corresponding to the output paper feed source information 763. In the next step S1109, the sub job controller 431 determines whether or not the value of cnt exceeds a detection threshold. If the value of cnt exceeds the detection threshold (e.g., five), the processing proceeds to step S1110, in which the sub job controller 431 determines the paper type on the basis of the content of the second paper type information 783 corresponding to the paper feed source indicated by the output paper feed source information 763. The printer engine 105 is notified of engine parameters based on the determined paper type via the device controller 434, and then, the processing proceeds to step S1103. In step S1103, the device controller 434 controls the printer engine 105 to feed a sheet from the paper feed source indicated by the output paper feed source information 763, and then, the processing proceeds to step S1104. Accordingly, the printer engine 105 conveys the sheet to a print position in step S1104, and waits until the temperature of the fixing unit reaches the fixing temperature included in the engine parameters in step S1105. In the next step S1106, the printer engine 105 prints an image on the sheet on the basis of the image data for printing 770 in accordance with the conveyance speed included in the engine parameters, and then, the processing is ended.

On the other hand, if the sub job controller 431 determines in step S1109 that the value of cnt does not exceed the detection threshold, the processing proceeds to step S1111. In step S1111, the sub job controller 431 controls the printer engine 105 to feed a sheet from the paper feed source indicated by the output paper feed source information 763 via the device controller 434. In the next step S1112, the printer engine 105 conveys a sheet from the indicated paper feed source to a sensor position, causes the media sensor 314 to detect the type of the sheet, and notifies the sub job controller 431 of the detected type. In the next step S1113, the sub job controller 431 stores the received detection result as the cntth detection result with respect to the indicated paper feed source to the provisional detection result 782 (see Table 5). In the next step S1114, the sub job controller 431 determines whether or not the value of cnt is equal to the detection threshold. If it is determined that the value of cnt is not equal to the detection threshold, the processing proceeds to step S1115, in which the sub job controller 431 updates the content of the second paper type information 783 corresponding to the paper feed source indicated by the output paper feed source information 763 on the basis of the 0th detection result, and then, the processing proceeds to step S1117. Specifically, the detection result of the paper type of the first sheet that is relatively correct is used.

On the other hand, if the sub job controller 431 determines in step S1114 that the value of cnt is equal to the detection threshold, the processing proceeds to step S1116. The sub job controller 431 obtains a paper type that has been detected most frequently among the 0th to the (detection threshold−1)th detection results included in the second paper type information 783 with respect to the paper feed source indicated by the output paper feed source information 763. In the example of Table 5, "thin paper" is obtained in the case of "cassette 4." The sub job controller 431 updates the content of the second paper type information 783 corresponding to the paper feed source indicated by the output paper feed source information 763 on the basis of the obtained paper type that has been detected most frequently, and then the processing proceeds to step S1117.

In step S1117, the sub job controller 431 notifies the printer engine 105 of engine parameters based on the content of the second paper type information 783 corresponding to the paper feed source indicated by the output paper feed source information 763 via the device controller 434. In the next step S1118, the sub job controller 431 increments the detection counter corresponding to the paper feed source indicated by the output paper feed source information 763 by one, and then, the processing proceeds to step S1104.

If the sub job controller 431 determines in step S1101 that the output paper type information 762 indicates "full detection," the processing proceeds to step S1119, in which the printer engine 105 feeds a sheet from the paper feed source indicated by the output paper feed source information 763. In the next step S1120, the printer engine 105 conveys the sheet to the sensor position, and then, the sub job controller 431 causes the media sensor 314 to detect the type of the sheet. In the next step S1121, the sub job controller 431 notifies the printer engine 105 of engine parameters corresponding to the paper type detected by the media sensor 314 via the device controller 434, and then, the processing proceeds to step S1104.

FIG. 12 is a flowchart for describing standby processing during a recovery in step S817 of FIG. 8B. FIGS. 13A and 13B show examples of an error screen displayed by the image forming apparatus 100 according to the first embodiment while on standby during the recovery.

First, in step S1201, the user operation reception module 405 updates a screen displayed on the display unit 124 in the console unit 101 on the basis of error information. It is preferable to display the output paper size information 761, the output paper feed source information 763, the output paper type information 762, and the like, in addition to the error information.

FIG. 13A shows a view illustrating an example of an error screen displayed when a paper change request has been issued with respect to the manual feed tray, and FIG. 13B shows a view illustrating an example of an error screen displayed when an out-of-paper error has occurred with respect to the cassette 1. These screens display the name of a target manual feed tray or cassette, together with the output paper size information and the output paper type information set for the target paper feed source.

In the next step S1202, the user operation reception module 405 waits for the occurrence of an event, and if any event occurs, the processing proceeds to step S1203. In step S1203, the user operation reception module 405 determines the type of the event that has occurred, and the processing diverges in accordance with the type of the event. If the event is pressing of the up button 121 or the down button 123, the processing first proceeds to step S1204, in which the user operation reception module 405 moves the cursor up or down, then to step S1201, in which a screen with the moved cursor is displayed, and then to step S1202 to wait for the occurrence of the next event.

If the event is pressing of the OK button 122 in the console unit 101, the processing proceeds from step S1203 to step S1205, in which the user operation reception module 405 checks the item being selected by a current cursor position (see FIGS. 13A and 13B). If the selected item is "cancel," the processing proceeds to step S1206, in which the user operation reception module 405 notifies the main job controller 401 of a cancellation instruction, and the main job controller 401 cancels the present job, and then, the processing is ended.

If the selected item is one of the paper feed sources in step S1205, the processing proceeds to step S1207, in which the user operation reception module 405 determines whether or not the paper size setting information 701 indicates "free" for the paper feed source indicated by the output paper feed source information 763. If the paper size setting information indicates "free," the processing proceeds to step S1209, and, if not, the processing proceeds to step S1208, in which the content of the paper size setting information corresponding to the indicated paper feed source is updated on the basis of the output paper size information 761, and then, the processing proceeds to step S1209. In step S1209, the user operation reception module 405 determines whether or not the first paper type information 702 indicates "free" for the paper feed source indicated by the output paper feed source information 763. If the first paper type information indicates "free," the processing proceeds to step S1211, and if not, the processing proceeds to step S1210, in which the content of the paper type information corresponding to the indicated paper feed source is updated on the basis of the output paper type information 762, and then, the processing proceeds to step S1211. In the next step S1211, the user operation reception module 405 updates the output paper feed source information 763 on the basis of the selected paper feed source, and then, the processing is ended.

If the event is closing of a door of a paper feed source in step S1203, the processing proceeds to step S1212, in which the user operation reception module 405 determines whether or not the paper feed source with the closed door matches the paper feed source indicated by the output paper feed source information 763. If they do not match, it means that a door of another paper feed source has been closed, and thus the processing proceeds to step S1201 similarly to the cases of other events. If the paper feed source with the closed door matches the paper feed source indicated by the output paper feed source information 763 in step S1212, the user operation reception module 405 ends the present recovery processing.

In the foregoing description of the first embodiment, when the output paper type information 762 indicates "panel priority," the content of the second paper type information 783 is referred to. Meanwhile, when a job is input with PDL data as raw data without using the printer driver, there may be a demand to select a paper feed source automatically. In view of this, when the output paper type information 762 matches a specific paper type, a paper feed source to be used in printing may be selected with reference to the content of the second paper type information 783. The specific paper type may be set by the user via the console unit 101, or may be held by a system as a fixed value. Alternatively, the default paper type information 705 may be used.

As described above, in the first embodiment, information of the paper types detected by the media sensor 314 from sheets loaded in the paper feed sources is held also after a job is ended, and thus can be utilized during the automatic paper feed source selection for the next job. In this way, during the automatic paper feed source selection, even if the paper types of sheets loaded in the paper feed sources are unknown, a paper feed source to be used in printing can be determined on the basis of the detection results in a previous job.

[Second Embodiment]

In the above-described first embodiment, a paper feed source for which the second paper type information indicates "undetected" can be selected as a paper feed source to be used in printing, so as to increase the opportunity for any paper feed source to be selected as an output paper feed source. A second embodiment describes an example in which selection of a paper feed source for which the second paper type information indicates a detected state is prioritized over selection of a paper feed source for which the second paper type information indicates an undetected state. Note that the image forming apparatus 100, the information processing apparatus 150, and the like, according to the second embodiment are configured in the same manner as in the above-described first embodiment, and thus, a description thereof is omitted.

Figure 14A:
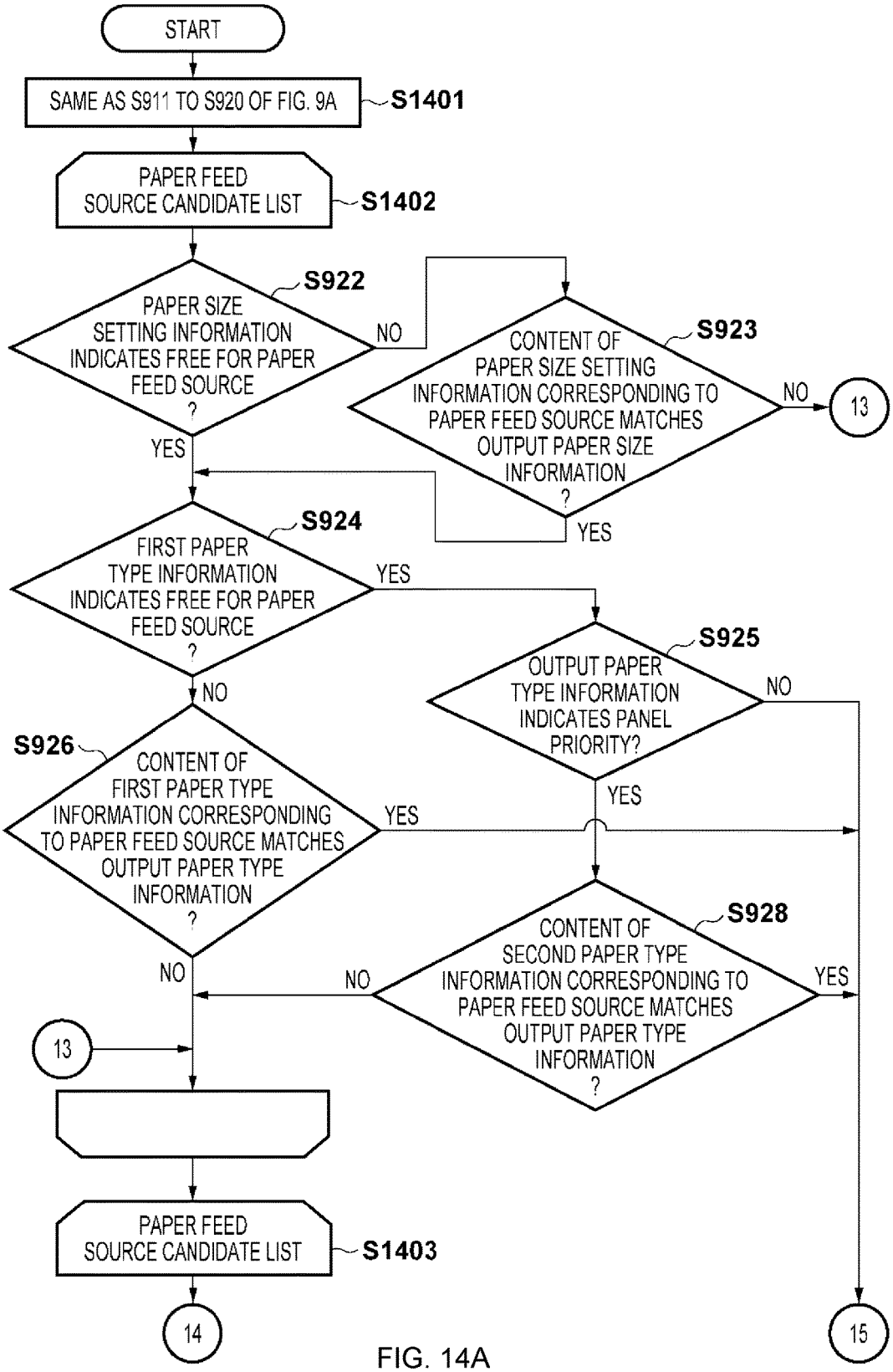
FIG. 14A is a flowchart for describing processing in which the image forming apparatus according to a second embodiment of the present invention determines output paper feed source information (step S803 of FIG. 8A).
Figure 14B:
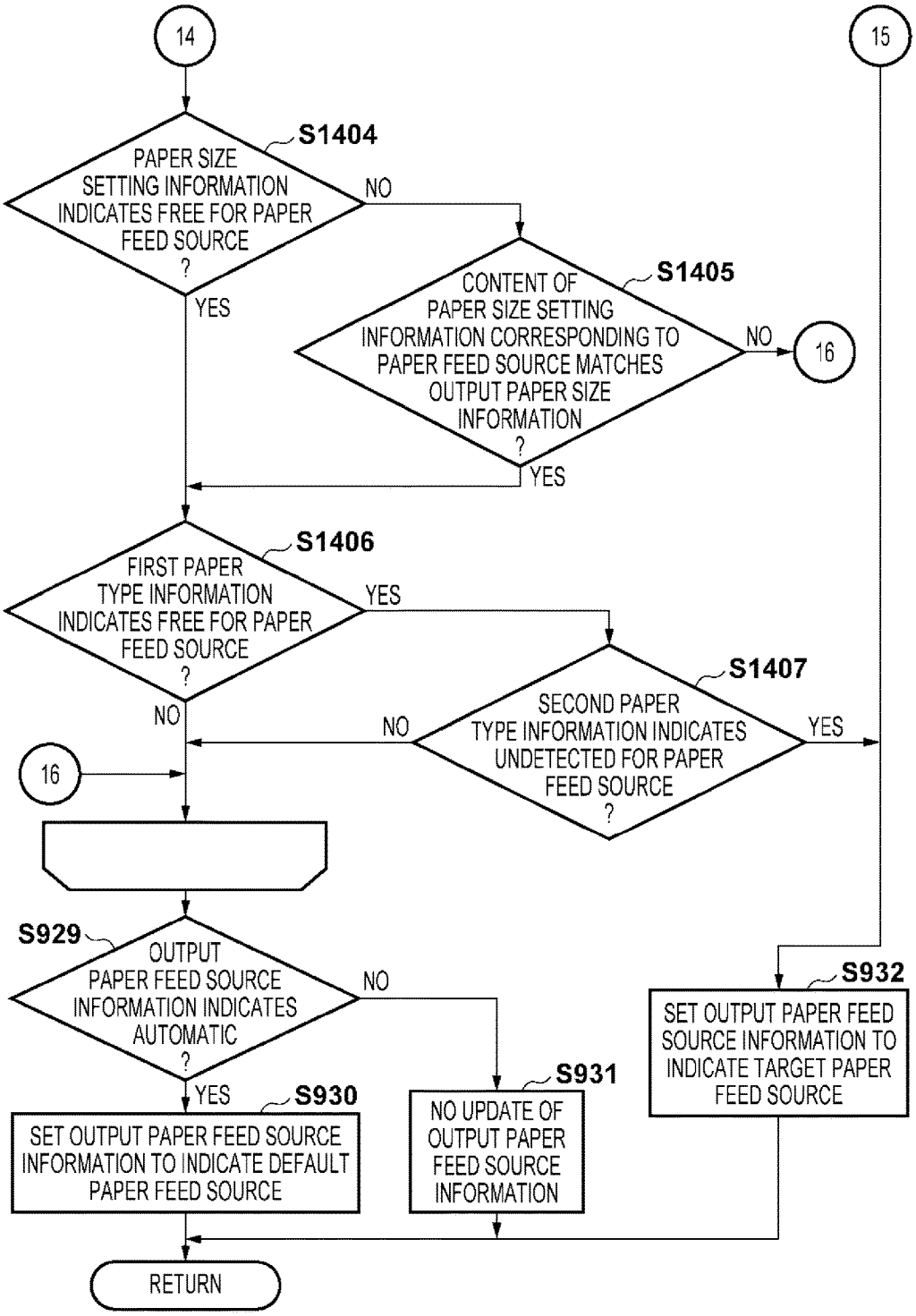
FIG. 14B is a flowchart for describing processing in which the image forming apparatus according to a second embodiment of the present invention determines output paper feed source information (step S803 of FIG. 8A).

FIGS. 14A and 14B are flowcharts for describing processing in which the image forming apparatus 100 according to the second embodiment of the present invention determines the output paper feed source information (step S803 of FIG. 8A). Note that the processes that are shared in common with the flowcharts of FIGS. 9A and 9B are given the same reference signs as used in those figures.

First, in step S1401, the main job controller 401 generates a paper feed source candidate list. This is the same as the above-described processes of step S911 to step S920 of FIG. 9A, and thus, a detailed description thereof is omitted. In the next step S1402, the main job controller 401 executes the following processes in sequence with respect to each of the paper feed sources included in the paper feed source candidate list.

In step S922, the main job controller 401 determines whether or not the paper size setting information 701 indicates "free" for a paper feed source indicated by the output paper feed source information. If the paper size setting information does not indicate "free," the processing proceeds to step S923, in which the main job controller 401 determines whether or not the corresponding content of the paper size setting information matches the output paper size information 761. If the corresponding content of the paper size setting information does not match the output paper size information 761, the processing proceeds to determination processes for the next paper feed source.

If the paper size setting information indicates "free" in step S922, or if the corresponding content of the paper size setting information matches the output paper size information 761 in step S923, the processing proceeds to step S924, in which the main job controller 401 determines whether or not the first paper type information 702 indicates "free" for the paper feed source indicated by the output paper feed source information 763. If the first paper type information does not indicate "free," the processing proceeds to step S926, in which the main job controller 401 determines whether or not the corresponding content of the first paper type information matches the output paper type information 762. If the first paper type information 702 does not indicate "free" for the paper feed source indicated by the output paper feed source information 763 and the corresponding content thereof does not match the output paper type information 762, the main job controller 401 proceeds to determination processes for the next paper feed source candidate. If the first paper type information 702 does not indicate "free" for the paper feed source indicated by the output paper feed source information 763 and the corresponding content thereof matches the output paper type information 762, the processing proceeds to step S932, in which the main job controller 401 sets the information of the paper feed source that is currently selected to the output paper feed source information 763, and then, the processing is ended.

If the first paper type information indicates "free" in step S924, the processing proceeds to step S925, in which the main job controller 401 determines whether or not the output paper type information 762 indicates "panel priority." If the output paper type information does not indicate "panel priority," the processing proceeds to step S932, in which the main job controller 401 sets the information of the paper feed source that is currently selected to the output paper feed source information 763, and then, the processing is ended. On the other hand, if the output paper type information 762 indicates "panel priority" in step S925, the processing proceeds to step S928, in which the main job controller 401 determines whether or not the content of the second paper type information 783 corresponding to the paper feed source indicated by the output paper feed source information 763 matches the output paper type information. If it is determined that they match, the processing proceeds to step S932, in which the main job controller 401 sets the information of the paper feed source that is currently selected to the output paper feed source information 763, and then, the processing is ended. On the other hand, if it is determined that they do not match in step S928, the main job controller 401 proceeds to determination processes for the next paper feed source candidate. At this time, if the second paper type information 783 indicates "undetected" for the paper feed source indicated by the output paper feed source information 763, the output paper type information 762 does not indicate "undetected," that is to say, they do not match.

In the next step S1403 and subsequent steps, the main job controller 401 repeats the following processes in sequence with respect to each of the paper feed source candidates included in the paper feed source candidate list.

In step S1404, the main job controller 401 determines whether or not the paper size setting information 701 indicates "free" for the paper feed source indicated by the output paper feed source information. If the paper size setting information does not indicate "free," the processing proceeds to step S1405, in which the main job controller 401 determines whether or not the corresponding content of the paper size setting information matches the output paper size information 761. If it is determined that they do not match, the processing proceeds to determination processes for the next paper feed source candidate. On the other hand, if the paper size setting information indicates "free" in step S1404, or if the corresponding content of the paper size setting information matches the output paper size information 761 in step S1405, the processing proceeds to step S1406. In step S1406, the main job controller 401 determines whether or not the first paper type information 702 indicates "free" for the paper feed source indicated by the output paper feed source information 763. If the first paper type information does not indicate "free" in step S1406, the processing proceeds to determination processes for the next paper feed source candidate. If the first paper type information 702 indicates "free" for the output paper feed source in step S1406, the processing proceeds to step S1407, in which the main job controller 401 determines whether or not the second paper type information 783 indicates "undetected" for the paper feed source indicated by the output paper feed source information 763. If it is determined that the second paper type information indicates "undetected," the processing proceeds to step S932, in which the output paper feed source information 763 is updated on the basis of the information of the indicated paper feed source, and then, the processing is ended. On the other hand, if the second paper type information 783 does not indicate "undetected" for the paper feed source indicated by the output paper feed source information 763 in step S1407, the processing proceeds to determination processes for the next paper feed source candidate.

If a paper feed source cannot be specified after determining whether output is possible with respect to all of the paper feed sources included in the paper feed source candidate list, the processing proceeds to step S929. In step S929, the main job controller 401 determines whether or not the output paper feed source information 763 indicates "automatic." If the output paper feed source information indicates "automatic," the processing proceeds to step S930, in which the main job controller 401 updates the output paper feed source information 763 on the basis of the default paper feed source information 703, and then, the processing is ended. If the output paper feed source information 763 does not indicate "automatic" in step S930, the processing proceeds to step S931, in which the main job controller 401 does not update the output paper feed source information 763, and then, the processing is ended.

As described above, compared to the first embodiment, the second embodiment prioritizes the use of a paper feed source for which the types of loaded sheets have already been detected over the use of a paper feed source for which the types of loaded sheets have not been detected yet. In this way, a paper feed source for which the types of loaded sheets are already known can be prioritized in paper feeding, thereby advantageously enabling the user to perform printing preferentially on sheets whose paper types are already known.

Other Embodiments

Embodiments of the present invention can also be realized by a computer of a system or an apparatus that reads out and executes computer executable instructions (e.g., one or more programs) recorded on a storage medium (that may also be referred to more fully as a 'non-transitory computer-readable storage medium') to perform the functions of one or more of the above-described embodiments and/or that includes one or more circuits (e.g., an application specific integrated circuit (ASIC)) for performing the functions of one or more of the above-described embodiments, and by a method performed by the computer of the system or the apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., a central processing unit (CPU), or a micro processing unit (MPU)) and may include a network of separate computers or separate processors to read out and to execute the computer executable instructions. The computer executable instructions may be provided to the computer, for example, from a network or the storage medium. The storage medium may include, for example, one or more of a hard disk, a random-access memory(RAM), a read only memory (ROM), a storage of distributed computing systems, an optical disk (such as a compact disc (CD), a digital versatile disc (DVD), or a Blu-ray Disc (BD™), a flash memory device, a memory card, and the like).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

I claim:

1. An image forming apparatus comprising:

(A) a plurality of sheet feed sources, each of the plurality of sheet feed sources being capable of storing a sheet;

(B) an image forming unit that forms an image on a sheet fed from any one of the plurality of sheet feed sources;

(C) a detector that detects a sheet type of the sheet fed from the one of the plurality of sheet feed sources;

(D) a memory that stores a set of instructions; and (E) at least one processor that executes instructions, of the set of instructions, to function as:

(a) a reception unit that receives, from an external apparatus, a print job that designates a sheet size;

(b) a storing unit that stores information for specifying (i) a sheet feed source, of the plurality of sheet feed sources, that stores the sheet having the sheet size designated by the print job received by the reception unit, and (ii) a sheet type, detected by the detector, of the sheet fed from the specified sheet feed source, in association with each other, and that stores a number of detections of the detector in association with the information for specifying a sheet feed source;

(c) a specifying unit that specifies a sheet type corresponding to a sheet feed source, of the plurality of sheet feed sources, that stores the sheet having the sheet size designated by the print job received by the reception unit, among sheet types stored by the storing unit, based on information for specifying a sheet feed source, of the plurality of sheet feed sources, that stores the sheet having the sheet size designated by the print job; and (d) an execution unit that causes the image forming unit to execute the print job based on the sheet type specified by the specifying unit, wherein, in a case in which the number of detections is less than a predetermined value, the at least one processor controls the detector to detect a sheet type of the sheet stored in the sheet feed source and having the sheet size designated by the print job received by the reception unit, and wherein, in a case in which the number of detections is equal to or greater than the predetermined value, the at least one processor controls the detector not to detect a sheet type of sheet stored in the sheet feed source and having the sheet size designated by the print job received by the reception unit.

2. The image forming apparatus according to claim 1, wherein the at least one processor executes the instructions to further function as (e) a setting unit that sets whether the detector detects the sheet type of the sheet fed from the sheet feed source, of the plurality of sheet feed sources.

3. A method of controlling an image forming apparatus having a plurality of sheet feed sources, each of the plurality of sheet feed sources being capable of storing a sheet, an image forming unit that forms an image on a sheet fed from any one of the plurality of sheet feed sources, and a detector that detects a sheet type of a sheet fed from the one of the plurality of sheet feed sources, the method comprising the steps of:

receiving, from an external apparatus, a print job that designates a sheet size;

storing information for specifying (i) a sheet feed source, of the plurality of sheet feed sources, that stores the sheet having the sheet size designated by the print job received in the receiving step, and (ii) a sheet type, detected by the detector, of a sheet fed from the specified sheet feed source in association with each other, wherein, in the storing step, a number of detections of the detector is stored in association with the information for specifying a sheet feed source;

specifying a sheet type corresponding to a sheet feed source, of the plurality of sheet feed sources, that stores the sheet having the sheet size designated by the print job received in the receiving step, among sheet types stored in the storing step, based on information for specifying a sheet feed source, of the plurality of sheet feed sources, that stores the sheet having the sheet size designated by the print job;

causing the image forming unit to execute the print job based on the sheet type specified in the specifying step;

controlling, in a case in which the number of detections is less than a predetermined value, the detector to detect a sheet type of the sheet stored in the sheet feed source and having the sheet size designated by the print job; and controlling, in a case in which the number of detections is equal to or greater than the predetermined value, the detector not to detect a sheet type of the sheet stored in the sheet feed source and having the sheet size designated by the print job.

4. The method according to claim 3, further comprising setting whether the detector detects the sheet type of a sheet fed from a sheet feed source, of the plurality of sheet feed sources.

5. A non-transitory computer-readable storage medium having stored therein a program for causing a computer to execute a method of controlling an image forming apparatus having a plurality of sheet feed sources, each of the plurality of sheet feed sources being capable of storing a sheet, an image forming unit that forms an image on a sheet fed from any one of the plurality of sheet feed sources, and a detector that detects a sheet type of a sheet fed from the one of the plurality of sheet feed sources, the method comprising the steps of:

receiving, from an external apparatus, a print job that designates a sheet size;

storing information for specifying (i) a sheet feed source, of the plurality of sheet feed sources, that stores the sheet having the sheet size designated by the print job received in the receiving step, and (ii) a sheet type, detected by the detector, of a sheet fed from the specified sheet feed source in association with each other, wherein, in the storing step, a number of detections of the detector is stored in association with the information for specifying a sheet feed source;

specifying a sheet type corresponding to a sheet feed source, of the plurality of sheet feed sources, that stores the sheet having the sheet size designated by the print job received in the receiving step, among sheet types stored in the storing step, based on information for specifying a sheet feed source, of the plurality of sheet feed sources, that stores the sheet having the sheet size designated by the print job;

causing the image forming unit to execute the print job based on the paper type specified in the specifying step;

controlling, in a case in which the number of detections is less than a predetermined value, the detector to detect a sheet type of the sheet stored in the sheet feed source and having the sheet size designated by the print job, and controlling, in a case in which the number of detections is equal to or greater than the predetermined value, the detector not to detect a sheet type of the sheet stored in the sheet feed source and having the sheet size designated by the print job.

6. The non-transitory computer-readable storage medium according to claim 5, wherein the method further comprises setting whether the detector detects the sheet type of a sheet fed from a sheet feed source, of the plurality of sheet feed sources.

* * * * *